US007208875B2

(12) United States Patent
Kwon et al.

(10) Patent No.: US 7,208,875 B2
(45) **Date of Patent: *Apr. 24, 2007**

(54) PLASMA DISPLAY PANEL

(75) Inventors: Jae-Ik Kwon, Ahsan (KR); Kyoung-Doo Kang, Seoul (KR)

(73) Assignee: Samsung SDI Co., Ltd., Sunwon (KR)

( * ) Notice: Subject to any disclaimer, the term of this patent is extended or adjusted under 35 U.S.C. 154(b) by 158 days.

This patent is subject to a terminal disclaimer.

(21) Appl. No.: 10/746,540

(22) Filed: Dec. 23, 2003

(65) Prior Publication Data

US 2004/0135508 A1 Jul. 15, 2004

(30) Foreign Application Priority Data

Jan. 2, 2003 (KR) ..... 10-2003-0000088
Jul. 4, 2003 (KR) ..... 10-2003-0045202

(51) Int. Cl.
*H01J 1/62* (2006.01)
*H01J 17/49* (2006.01)

(52) U.S. Cl. ..... 313/582; 313/584

(58) Field of Classification Search ..... 313/581–587
See application file for complete search history.

(56) References Cited

U.S. PATENT DOCUMENTS 5,640,068 A 6/1997 Amemiya
5,661,500 A 8/1997 Shinoda et al.
5,952,782 A 9/1999 Nanto et al.
6,200,182 B1 3/2001 Nanto et al.
6,249,264 B1 * 6/2001 Sano et al. ..... 345/60
6,288,488 B1 9/2001 Amemiya
6,373,195 B1 4/2002 Whang et al.
6,376,986 B1 * 4/2002 Takagi et al. ..... 313/582

(Continued)

FOREIGN PATENT DOCUMENTS

CN 1264914 8/2000

(Continued)

OTHER PUBLICATIONS

European Patent Office Search Report, dated Feb. 3, 2005, for application No. 04090020.1, in the name of Samsung SDI Co., Ltd.

(Continued)

*Primary Examiner*—Ashok Patel
(74) *Attorney, Agent, or Firm*—Christie, Parker & Hale, LLP

(57) ABSTRACT

A plasma display panel. A first substrate and a second substrate are provided opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions. Phosphor layers are formed within each of the discharge cells. Discharge sustain electrodes are formed on the first substrate. The non-discharge regions are formed in areas encompassed by discharge cell abscissas and ordinates that pass through centers of each of the discharge cells. Further, each of the discharge cells is formed such that ends thereof increasingly decrease in width along a direction the discharge sustain electrodes are formed as a distance from a center of the discharge cells is increased along a direction the address electrodes are formed.

25 Claims, 18 Drawing Sheets

U.S. PATENT DOCUMENTS

| | | | | |
|---|---|---|---|---|
| 6,424,095 | B1 | 7/2002 | Hirao et al. | |
| 6,479,932 | B1 | 11/2002 | Nunomura | |
| 6,495,957 | B2 * | 12/2002 | Kurogi et al. | 313/584 |
| 6,534,914 | B2 * | 3/2003 | Amemiya et al. | 313/586 |
| 6,639,363 | B2 | 10/2003 | Amatsuchi et al. | |
| 6,657,386 | B2 * | 12/2003 | Koshio et al. | 313/586 |
| 6,670,754 | B1 | 12/2003 | Murai et al. | |
| 6,703,772 | B2 | 3/2004 | Hasegawa et al. | |
| 6,853,136 | B2 | 2/2005 | Kim et al. | |
| 2002/0021090 | A1 | 2/2002 | Sano et al. | |
| 2003/0193487 | A1 | 10/2003 | Yatsuda et al. | |
| 2004/0051457 | A1 | 3/2004 | Kimura et al. | |
| 2004/0085264 | A1 | 5/2004 | Takada et al. | |
| 2004/0135509 | A1 | 7/2004 | Kwon et al. | |
| 2004/0201350 | A1 | 10/2004 | Kwon et al. | |
| 2004/0263078 | A1 | 12/2004 | Woo et al. | |
| 2005/0001551 | A1 | 1/2005 | Kim et al. | |
| 2005/0017637 | A1 | 1/2005 | Kang et al. | |
| 2005/0029939 | A1 | 2/2005 | Woo et al. | |

FOREIGN PATENT DOCUMENTS

| | | | |
|---|---|---|---|
| CN | 1267877 | | 9/2000 |
| CN | 1327253 | | 12/2001 |
| CN | 1337665 | | 2/2002 |
| CN | 1344005 | | 4/2002 |
| CN | 1397976 | A | 2/2003 |
| EP | 0 920 048 | A2 | 6/1999 |
| EP | 1 263 014 | A1 | 12/2002 |
| EP | 2003-303550 | | 10/2003 |
| EP | 2003-303551 | | 10/2003 |
| JP | 4-298936 | | 10/1992 |
| JP | 5-94772 | | 4/1993 |
| JP | 6-342631 | | 12/1994 |
| JP | 10-149771 | | 6/1998 |
| JP | 10-269951 | | 10/1998 |
| JP | 10-283934 | | 10/1998 |
| JP | 10-308179 | | 11/1998 |
| JP | 10-334811 | | 12/1998 |
| JP | 11-96921 | | 4/1999 |
| JP | 11-213893 | | 8/1999 |
| JP | 11-317170 | | 11/1999 |
| JP | 11-345570 | | 12/1999 |
| JP | 2000-11899 | | 1/2000 |
| JP | 2000-21313 | | 1/2000 |
| JP | 2000-42661 | | 2/2000 |
| JP | 2000-187200 | | 7/2000 |
| JP | 2000-195431 | | 7/2000 |
| JP | 2000-323045 | | 11/2000 |
| JP | 2000-357459 | | 12/2000 |
| JP | 2001-160361 | | 6/2001 |
| JP | 2001-210241 | | 8/2001 |
| JP | 2001-283734 | | 10/2001 |
| JP | 2001-345054 | | 12/2001 |
| JP | 2002-25451 | | 1/2002 |
| JP | 2002-83545 | | 3/2002 |
| JP | 2002-190256 | | 7/2002 |
| JP | 2002-197981 | | 7/2002 |
| JP | 2002-231146 | | 8/2002 |
| JP | 2002-245943 | | 8/2002 |
| JP | 2002-260537 | | 9/2002 |
| JP | 2002-324488 | | 11/2002 |
| JP | 2002-373593 | | 12/2002 |
| JP | 2003-16944 | | 1/2003 |
| JP | 2003-31130 | | 1/2003 |
| JP | 2003-68212 | | 3/2003 |
| JP | 2003-68215 | | 3/2003 |
| JP | 2003-132805 | | 5/2003 |
| JP | 2004-164885 | | 6/2004 |
| KR | 1998-030878 | | 8/1998 |
| KR | 1999-0062632 | | 7/1999 |
| KR | 1999-0065408 | | 8/1999 |
| KR | 2001-0016651 | | 3/2001 |
| KR | 2001-0062222 | | 7/2001 |
| KR | 2001-0093724 | | 10/2001 |
| KR | 2002-0036012 | | 5/2002 |
| KR | 2002-0055807 | | 7/2002 |
| KR | 2002-0069025 | | 8/2002 |
| KR | 2003-0044667 | | 6/2003 |
| KR | 2003-0061079 | | 7/2003 |
| KR | 10-2004-0032508 | | 4/2004 |
| WO | WO99/50877 | | 10/1999 |
| WO | WO00/46832 | | 8/2000 |

OTHER PUBLICATIONS

Korean Patent Abstracts for publication No. 1020030061079, with a date of publication of Jul. 18, 2003, in the name of Y. Ahn et al.
Korean Patent Abstracts for publication No. 1020010093724, with a date of publication of Oct. 29, 2001, in the name of K. Morikawa et al.
Korean Patent Abstracts for publication No. 1020040032508, with a date of publication of Apr. 17, 2004, in the name of B. Lee.
Patent Abstracts of Japan for publication No. 2001-210241, with a date of publication of Aug. 3, 2001, in the name of T. Kosaka.
Patent Abstracts of Japan for publication No. 2002-083545, with a date of publication of Mar. 22, 2002, in the name of Y. Kunii et al.
Patent Abstracts of Japan for publication No. 2000-195431, with a publication date of Jul. 14, 2000, in the name of T. Komaki et al.
European Patent Office Patent Abstracts of Japan for publication No. 2003-303551, with a publication date of Oct. 24, 2003, in the name of S. Kan.
European Patent Office Patent Abstracts of Japan for publication No. 2003303550, with a publication date of Oct. 24, 2003, in the name of S. Kan.
European Patent Office Patent Abstracts of Japan for publication No. 2002245943, with a publication date of Aug. 30, 2002, in the name of T. Sakurai.

* cited by examiner

PLASMA DISPLAY PANEL

CROSS REFERENCE TO RELATED APPLICATIONS

This application claims priority to and the benefit of Korea Patent Applications No. 2003-0000088 filed on Jan. 2, 2003 and No. 2003-0045202 filed on Jul. 4, 2003, both in the Korean Intellectual Property Office, the content of which are both incorporated herein by reference.

BACKGROUND OF THE INVENTION (a) Field of the Invention

The present invention relates to a plasma display panel (PDP), and more particularly, to a plasma display panel having a barrier rib structure between two substrates that defines discharge cells into independent units.

(b) Description of the Related Art

A PDP is typically a display device in which ultraviolet rays generated by the discharge of gas excite phosphors to realize predetermined images. As a result of the high resolution possible with PDPs (even with large screen sizes), many believe that they will become a major, next generation flat panel display configuration.

In a conventional PDP, with reference to FIG. 16, address electrodes 101 are formed along one direction (axis X direction in the drawing) on rear substrate 100. Dielectric layer 103 is formed over an entire surface of rear substrate 100 on which address electrodes 101 are located such that dielectric layer 103 covers address electrodes 101. Barrier ribs 105 are formed on dielectric layer 103 in a striped pattern and at locations corresponding to between address electrodes 101. Formed between barrier ribs 105 are red, green, and blue phosphor layers 107.

Formed on a surface of front substrate 110 facing rear substrate 100 are discharge sustain electrodes 114. Each of the discharge sustain electrodes 114 includes a pair of transparent electrodes 112 and a pair of bus electrodes 113. Transparent electrodes 112 and bus electrodes 113 are arranged in a direction substantially perpendicular to address electrodes 101 of rear substrate 100 (axis Y direction). Dielectric layer 116 is formed over an entire surface of front substrate 110 on which discharge sustain electrodes 114 are formed such that dielectric layer 116 covers discharge sustain electrodes 114. MgO protection layer 118 is formed covering entire dielectric layer 116.

Areas between where address electrodes 101 of rear substrate 100 and discharge sustain electrodes 114 of front substrate 110 intersect become areas that form discharge cells.

An address voltage Va is applied between address electrodes 101 and discharge sustain electrodes 114 to perform address discharge, then a sustain voltage Vs is applied between a pair of the discharge sustain electrodes 114 to perform sustain discharge. Ultraviolet rays generated at this time excite corresponding phosphor layers such that visible light is emitted through transparent front substrate 110 to realize the display of images.

However, with the PDP structure in which discharge sustain electrodes 114 are formed as shown in FIG. 16 and barrier ribs 105 are provided in a striped pattern, crosstalk may occur between adjacent discharge cells (i.e., discharge cells adjacent to one another with barrier ribs 105 provided therebetween). Further, since there is no structure provided between adjacent barrier ribs 105 for dividing the discharge cells, it is possible for mis-discharge to occur between adjacent discharge cells within adjacent barrier ribs 105. To prevent these problems, it is necessary to provide a minimum distance between discharge sustain electrons 114 corresponding to adjacent pixels. However, this limits efforts at improving discharge efficiency.

In an effort to remedy these problems, PDPs having improved electrode and barrier rib structures have been disclosed as shown in FIGS. 17 and 18.

In the PDP structure appearing in FIG. 17, although barrier ribs 121 are formed in the typical striped pattern, discharge sustain electrodes 123 are changed in configuration. That is, discharge sustain electrodes 123 include transparent electrodes 123*a* and bus electrodes 123*b*, with a pair of transparent electrodes 123*a* being formed for each discharge cell in such a manner to extend from bus electrodes 123*b* and oppose one another. U.S. Pat. No. 5,661,500 discloses a PDP with such a configuration. However, in the PDP structured in this manner, mis-discharge along the direction that barrier ribs 121 are formed remains a problem.

In the PDP structure appearing in FIG. 18, a matrix structure for barrier ribs 125 is realized. In particular, barrier ribs 125 include vertical barrier ribs 125*a* and horizontal barrier ribs 125*b* that intersect. Japanese Laid-Open Patent No. Heisei 10-149771 discloses a PDP with such a configuration.

However, with the use of such a matrix barrier rib structure, since all areas except for where the barrier ribs are formed are designed as discharge regions, there come to be present only areas that generate heat and no areas that absorb or disperse heat. As a result, after a certain amount of time has elapsed, temperature differences occur between cells in which discharge occurs and in which discharge does not occur. These temperature differences not only affect discharge characteristics, but also result in differences in brightness, the generation of bright afterimages, and other such quality problems. Bright afterimages refers to a difference in brightness occurring between a localized area and its peripheries even after a pattern of brightness that is greater than its peripheries is displayed for a predetermined time interval then returned to the brightness of the overall screen.

Further, in the PDP having barrier ribs 125 of such a matrix structure, either the phosphor layers are unevenly formed in corner areas that define the discharge cells, or the distance from the phosphor layers to discharge sustain electrodes 127 is significant enough that the efficiency of converting into visible light is reduced.

SUMMARY OF THE INVENTION

In accordance with the present invention, a plasma display panel is provided that optimizes a structure of electrodes and discharge cells that effect discharge to thereby maximize discharge efficiency, and increase efficiency of converting vacuum ultraviolet rays to visible light such that discharge stability is ensured.

Further in accordance with the present invention, a plasma display panel is provided in which sections of barrier ribs that define discharge cells are formed in a stepped configuration to allow easy evacuation of the plasma display panel during manufacture of the same.

In one embodiment of the present invention a plasma display panel includes a first substrate and a second substrate opposing one another with a predetermined gap therebetween. Address electrodes are formed on the second substrate. Barrier ribs are mounted between the first substrate and the second substrate, the barrier ribs defining a plurality of discharge cells and a plurality of non-discharge regions.

Phosphor layers are formed within each of the discharge cells. Discharge sustain electrodes are formed on the first substrate. The non-discharge regions are formed in areas encompassed by discharge cell abscissas and ordinates that pass through centers of each of the discharge cells. The discharge cell abscissas typically pass through centers of adjacent discharge cells and discharge cell ordinates typically pass through centers of adjacent discharge cells. The non-discharge regions may be respectively centered between the discharge cell abscissas that pass through centers of adjacent discharge cells and the discharge cell ordinates that pass through centers of adjacent discharge cells. Each of the non-discharge regions may be formed by the barrier ribs in a manner having an independent cell structure. The non-discharge regions are formed by barrier ribs separating adjacent discharge cells. The non-discharge regions may also be formed by barrier ribs separating diagonally adjacent discharge cells. Also, the non-discharge regions formed into independent cell structures may be divided into a plurality of individual cells. In effect, a non-discharge region may be divided into a plurality of non-discharge sub-regions by at least one partition barrier rib located within the non-discharge region. Pairs of the discharge cells adjacent in a direction the discharge sustain electrodes may be formed sharing at least one barrier rib.

In one embodiment, a plasma display panel is provided in which if a length of the discharge cells is along a direction the address electrodes are formed, each of the discharge cells is formed such that ends thereof increasingly decrease in width along a direction the discharge sustain electrodes are formed as a distance from a center of the discharge cells is increased.

In one embodiment both ends of each of the discharge cells along a direction the address electrodes are formed have an increasingly decreasing depth as a distance from a center of the discharge cells is increased, the depths being measured from an end of the barrier ribs adjacent to the first substrate in a direction toward the second substrate.

Both ends of each of the discharge cells along a direction the address electrodes are formed may have a configuration substantially in the shape of a trapezoid, may be wedge-shaped, or may be arc-shaped. Barrier ribs shared by each pair of discharge cells adjacent along a direction the discharge sustain electrodes are formed are formed in parallel.

In one embodiment, a plasma display panel is provided in which the non-discharge regions are formed in areas encompassed by discharge cell abscissas and ordinates that pass through centers of each of the discharge cells, and the barrier ribs forming the discharge cells include first barrier rib members, which are parallel to a direction the address electrodes are formed, and second barrier rib members, which are not parallel to the direction the address electrodes are formed. In one embodiment the second barrier rib members intersect the direction the address electrodes are formed.

The first barrier rib members and second barrier rib members may have different heights. The first barrier rib members may be higher or lower than the second barrier rib members.

In one embodiment, a plasma display panel is provided in which the non-discharge regions are formed in areas encompassed by discharge cell abscissas and ordinates that pass through centers of each of the discharge cells, if a length of the discharge cells is along a direction the address electrodes are formed, each of the discharge cells is formed such that ends thereof increasingly decrease in width along a direction the discharge sustain electrodes are formed as a distance from a center of the discharge cells is increased, and the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell.

Proximal ends of the protrusion electrodes where the protrusion electrodes are connected to and extend from the bus electrodes decrease in width in the direction the bus electrodes may be formed as the distance from the center of the discharge cells is increased, and the proximal ends of the protrusion electrodes may be formed corresponding to the shape of the ends of the discharge cells.

A distal end of each of the protrusion electrodes opposite proximal ends connected to and extended from the bus electrodes may be formed including an indentation, and in one embodiment the indentation is formed substantially in a center of the distal ends of each of the protrusion electrodes along the direction the bus electrodes are formed. Also, a protrusion may be formed to both sides of the indentations of each of the protrusion electrodes, and in on embodiment edges of the indentations of each of the protrusion electrodes are rounded with no abrupt changes in angle.

The protrusion electrodes may be transparent.

DETAILED DESCRIPTION

Figure 1:
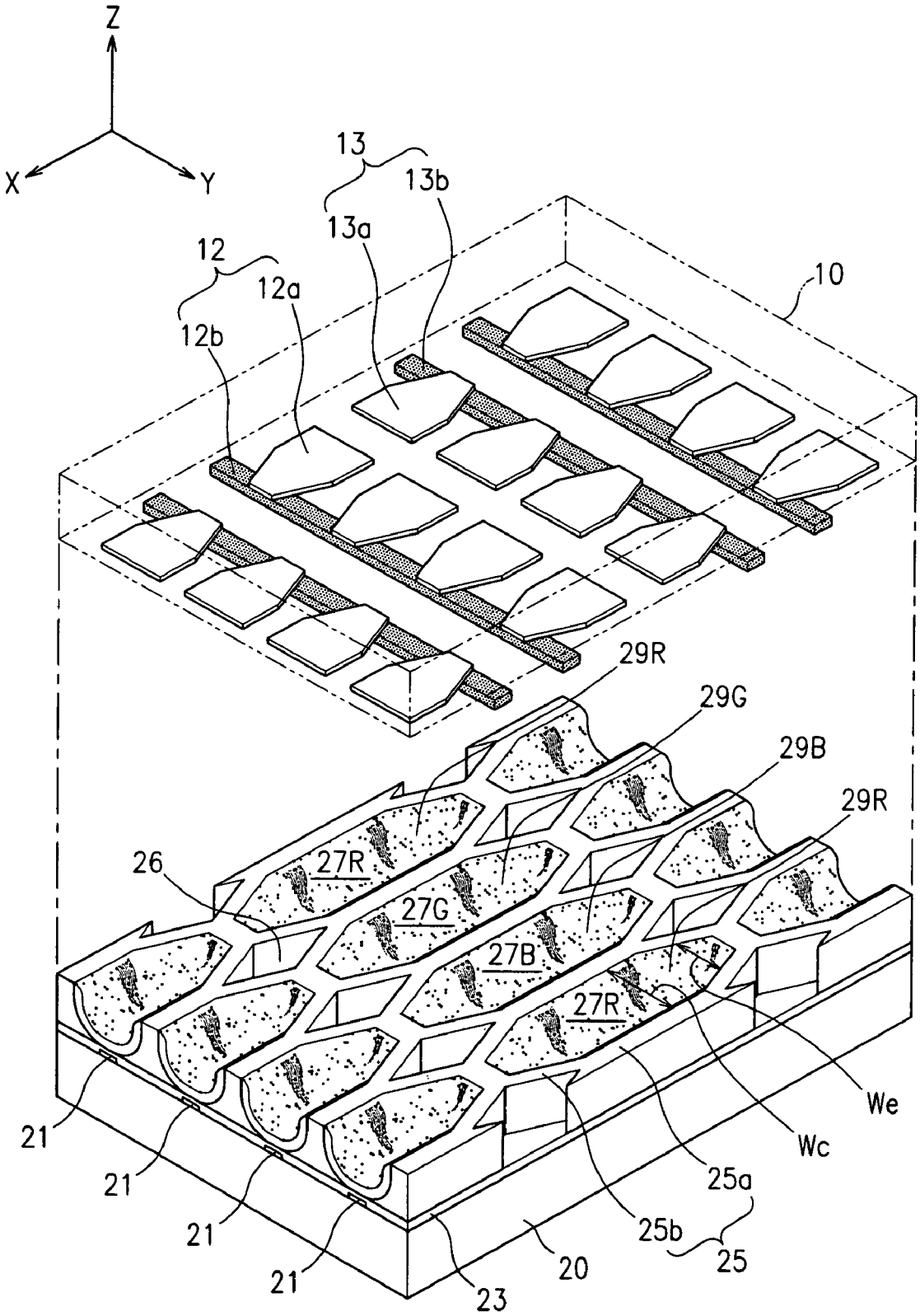
FIG. 1 is a sectional exploded perspective view of a plasma display panel according to a first embodiment of the present invention.
Figure 2:
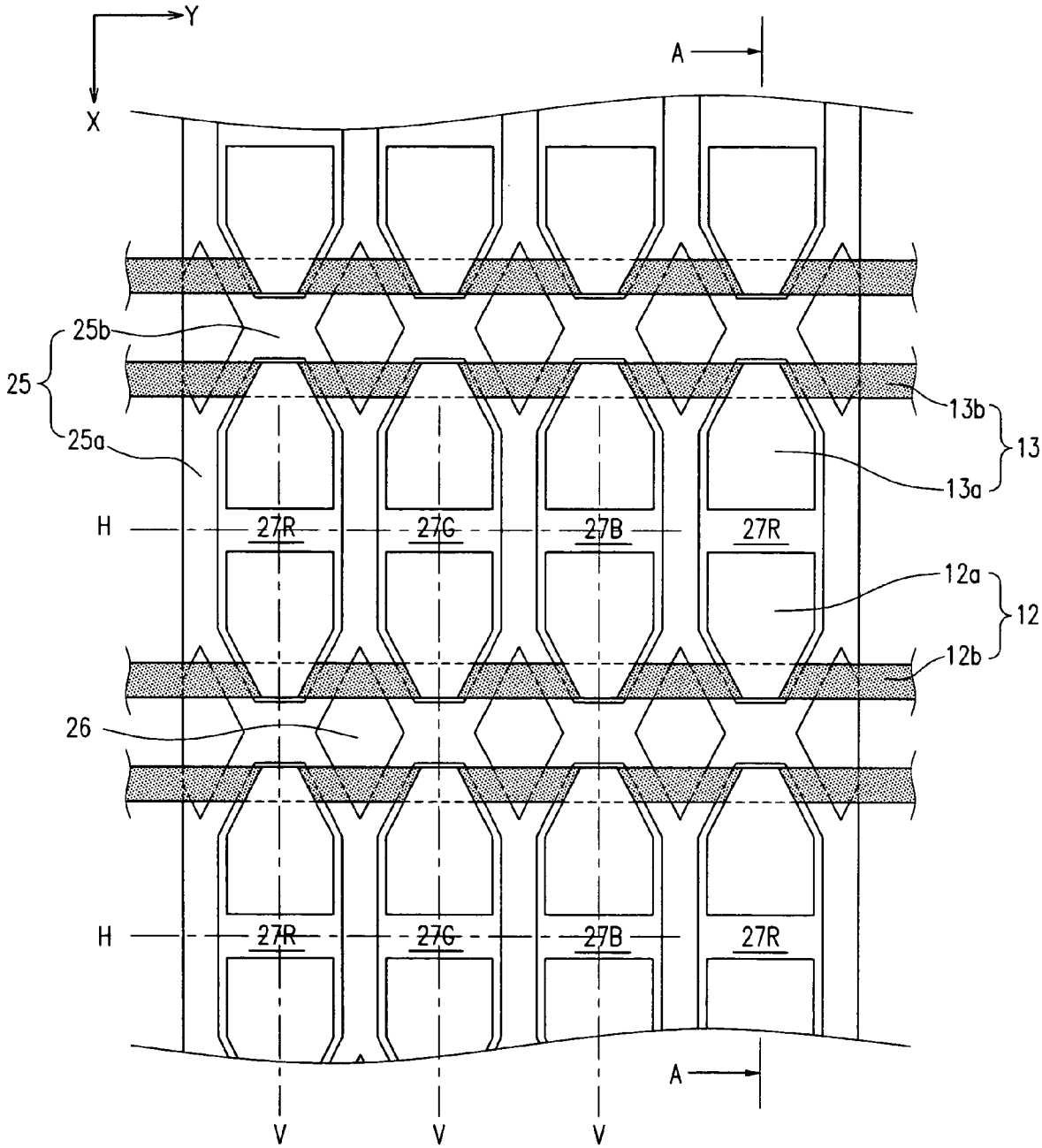
FIG. 2 is a partial plan view of the plasma display panel of FIG. 1.

FIG. 1 is a sectional exploded perspective view of a plasma display panel according to a first embodiment of the present invention with FIG. 2 being a partial plan view of the plasma display panel of FIG. 1.

A plasma display panel (PDP) according to the first embodiment includes first substrate 10 and second substrate 20 provided substantially in parallel with a predetermined gap therebetween. A plurality of discharge cells 27R, 27G, and 27B in which plasma discharge takes place is defined by barrier ribs 25 between first substrate 10 and second substrate 20. Discharge sustain electrodes 12 and 13 are formed on first substrate 10, and address electrodes 21 are formed on second substrate 20. This basic structure of the PDP will be described in greater detail below.

A plurality of address electrodes 21 is formed along one direction (direction X in the drawings) on a surface of second substrate 20 opposing first substrate 10. Address electrodes 21 are formed in a striped pattern with a uniform, predetermined interval between adjacent address electrodes 21. A dielectric layer 23 is formed on the surface of second substrate 20 on which address electrodes 21 are formed. Dielectric layer 23 may be formed extending over this entire surface of second substrate 20 to thereby cover address electrodes 21. In this embodiment, although address electrodes 21 were described as being provided in a striped pattern, the present invention is not limited to this configuration and address electrodes 21 may be formed in a variety of different patterns and shapes.

Barrier ribs 25 define the plurality of discharge cells 27R, 27G, and 27B, and also non-discharge regions 26 in the gap between first substrate 10 and second substrate 20. In one embodiment barrier ribs 25 are formed over dielectric layer 23, which is provided on second substrate 20 as described above. Discharge cells 27R, 27G, and 27B designate areas in which discharge gas is provided and where gas discharge is expected to take place with the application of an address voltage and a discharge sustain voltage. Non-discharge regions 26 are areas where a voltage is not applied such that gas discharge (i.e., illumination) is not expected to take place therein. Non-discharge regions 26 are areas that are at least as big as a thickness of barrier ribs 25 in a direction Y.

Referring to FIGS. 1 and 2, non-discharge regions 26 defined by barrier ribs 25 are formed in areas encompassed by discharge cell abscissas H and ordinates V that pass through centers of each of the discharge cells 27R, 27G, and 27B, and that are respectively aligned with direction X and direction Y. In one embodiment, non-discharge regions 26 are centered between adjacent abscissas H and adjacent ordinates V. Stated differently, in one embodiment each pair of discharge cells 27R, 27G, and 27B adjacent to one another along direction X has a common non-discharge region 26 with another such pair of discharge cells 27R, 27G, and 27B adjacent along direction Y. With this configuration realized by barrier ribs 25, each of the non-discharge regions 26 has an independent cell structure.

Discharge cells 27R, 27G, and 27B adjacent in the direction discharge sustain electrodes 12 and 13 are mounted (direction Y) are formed sharing at least one of the barrier ribs 25. Also, each of the discharge cells 27R, 27G, and 27B is formed with ends that reduce in width in the direction of discharge sustain electrodes 12 and 13 (direction Y) as a distance from a center of each of the discharge cells 27R, 27G, and 27B is increased in the direction address electrodes 21 are provided (direction X). That is, as shown in FIG. 1, a width Wc of a mid-portion of discharge cells 27R, 27G, and 27B is greater than a width We of the ends of discharge cells 27R, 27G, and 27B, with width We of the ends decreasing up to a certain point as the distance from the center of the discharge cells 27R, 27G, and 27B is increased. Therefore, in the first embodiment, the ends of discharge cells 27R, 27G, and 27B are formed in the shape of a trapezoid until reaching a predetermined location where barrier ribs 25 close off discharge cells 27R, 27G, and 27B. This results in each of the discharge cells 27R, 27G, and 27B having an overall planar shape of an octagon.

Barrier ribs 25 defining non-discharge regions 26 and discharge cells 27R, 27G, and 27B in the manner described above include first barrier rib members 25*a* that are parallel to address electrodes 21, and second barrier rib members 25*b* that define the ends of discharge cells 27R, 27G, and 27B as described above and so are not parallel to address electrodes 21. In the first embodiment, second barrier rib members 25*b* are formed extending up to a point, then extending in the direction discharge sustain electrodes 12 and 13 are formed to cross over address electrodes 21. Therefore, second barrier rib members 25*b* are formed in substantially an X shape between discharge cells 27R, 27G, and 27B adjacent along the direction of address electrodes 21. Second barrier rib members 25*b* can further separate diagonally adjacent discharge cells with a non-discharge region therebetween.

Red (R), green (G), and blue (B) phosphors are deposited within discharge cells 27R, 27G, and 27B to form phosphor layers 29R, 29G, and 29B, respectively. This will be described in more detail with reference to FIG. 3, which is a sectional view taken along line A—A of FIG. 2.

Figure 3:
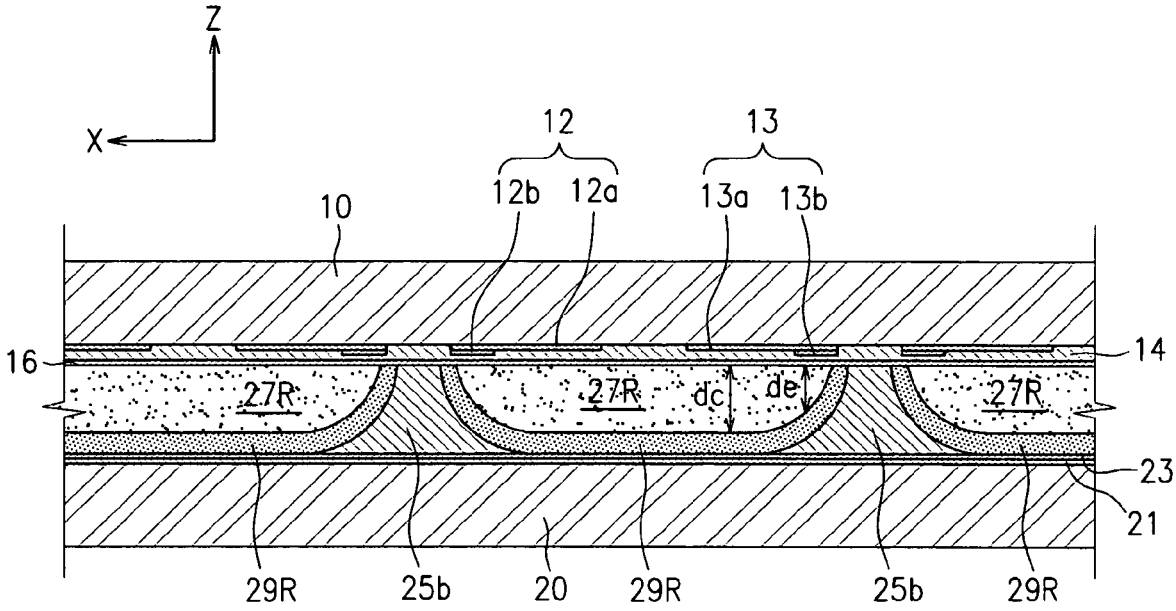
FIG. 3 is a sectional view taken along line A—A of FIG. 2.

With reference to FIG. 3, a depth at both ends of discharge cells 27R along the direction of address electrodes 21 decreases as the distance from the center of discharge cells 27R is increased. That is, a depth de at the ends of discharge cells 27R is less than a depth dc at the mid-portions of discharge cells 27R, with the depth de decreasing as the distance from the center is increased along direction X.

As a result of such a formation of depths de and dc of discharge cells 27R, distances between phosphor layers 29R and discharge sustain electrodes 12 and 13 is decreased at the ends of discharge cells 27R. Since the strength of gas discharge is relatively low at the ends of discharge cells 27R, this configuration increases the efficiency of converting vacuum ultraviolet rays to visible light in these areas. Discharge cells 27G and 27B of the other colors are formed identically to discharge cells 27R and therefore operate in the same manner.

With respect to first substrate 10, a plurality of the discharge sustain electrodes 12 and 13 is formed on the surface of first substrate 10 opposing second substrate 20. Discharge sustain electrodes 12 and 13 are extended in a direction (direction Y) substantially perpendicular to the direction (direction X) of address electrodes 21. Further, a dielectric layer 14 is formed over an entire surface of first substrate 10 covering discharge sustain electrodes 12 and 13, and an MgO protection layer 16 is formed on dielectric layer 14. To simplify the drawings, dielectric layer 14 and MgO protection layer 16 shown in FIG. 3 are not shown in FIGS. 1 and 2.

Discharge sustain electrodes 12 and 13 respectively include bus electrodes 12*b* and 13*b* that are formed in a striped pattern, and protrusion electrodes 12*a* and 13*a* that are formed extended from bus electrodes 12*b* and 13*b*, respectively. For each row of discharge cells 27R, 27G, and 27B along direction Y, bus electrodes 12*b* are extended into one end of discharge cells 27R, 27G, and 27B, and bus electrodes 13*b* are extended into an opposite end of discharge cells 27R, 27G, and 27B. Therefore, each of the discharge cells 27R, 27G, and 27B has one of the bus electrodes 12*b* positioned over one end, and one of the bus electrodes 13*b* positioned over its other end.

That is, for each row of discharge cells 27R, 27G, and 27B along direction Y, protrusion electrodes 12*a* overlap and protrude from corresponding bus electrode 12*b* into the areas of the discharge cells 27R, 27G, and 27B. Protrusion electrodes 13*a* overlap and protrude from the corresponding bus electrode 13*b* into the areas of discharge cells 27R, 27G, and 27B. Therefore, one protrusion electrode 12*a* and one protrusion electrode 13*a* are formed opposing one another in each area corresponding to each of the discharge cells 27R, 27G, and 27B.

Proximal ends of protrusion electrodes 12*a* and 13*a* (i.e., where protrusion electrodes 12*a* and 13*a* are attached to and extend from bus electrodes 12*b* and 13*b*, respectively) are formed corresponding to the shape of the ends of discharge cells 27R, 27G, and 27B. That is, the proximal ends of protrusion electrodes 12*a* and 13*a* reduce in width along direction Y as the distance from the center of discharge cells 27R, 27G, and 27B along direction X is increased to thereby correspond to the shape of the ends of discharge cells 27R, 27G, and 27B.

Protrusion electrodes 12*a* and 13*a* are realized through transparent electrodes such as ITO (indium tin oxide) electrodes. In one embodiment, metal electrodes are used for bus electrodes 12*b* and 13*b*.

Figure 4:
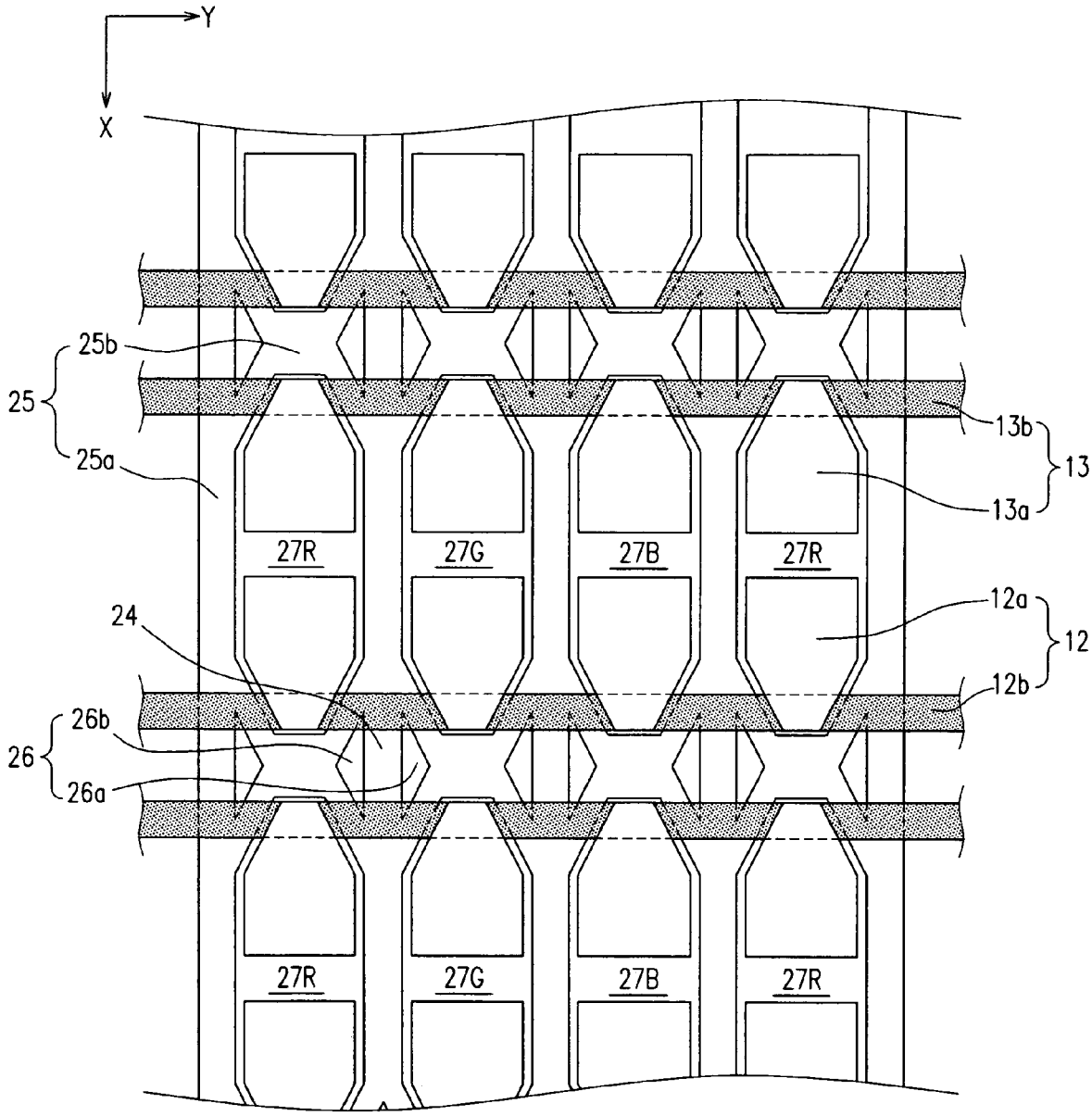
FIG. 4 is a partial plan view of a modified example of the plasma display panel of FIG. 1.

FIG. 4 is a partial plan view of a modified example of the plasma display panel of FIG. 1.

Partition barrier ribs 24 are formed in direction X passing through centers of non-discharge regions 26. Partition barrier ribs 24 may be formed by extending first barrier rib members 25*a*. With the formation of partition barrier ribs 24, non-discharge regions 26 are divided into two sections 26*a* and 26*b*. forming non-discharge sub-regions. It should be noted that non-discharge regions 26 may be divided into more than the two sections depending on the number and formation of partition barrier ribs 24.

In the following, PDPs according to second through eighth embodiments of the present invention will be described. In these PDPs, although the basic structure of the PDP of the first embodiment is left intact, the barrier rib structure of second substrate 20 and the discharge sustain electrode structure of first substrate 10 are changed to improve discharge efficiency. Like reference numerals will be used in the following description for elements identical to those of the first embodiment.

Figure 5:
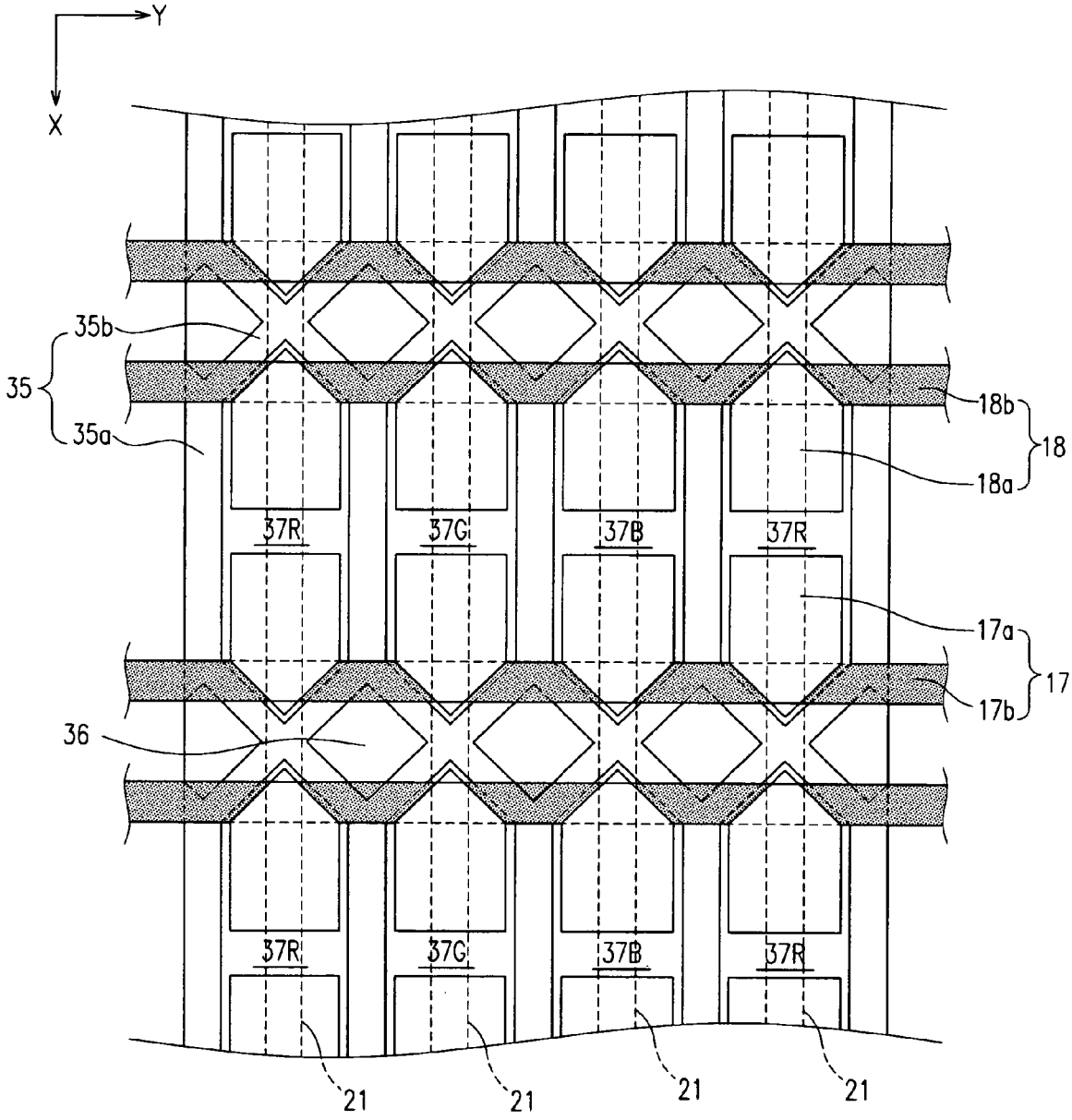
FIG. 5 is a partial plan view of a plasma display panel according to a second embodiment of the present invention.

FIG. 5 is a partial plan view of a plasma display panel according to a second embodiment of the present invention.

As shown in the drawing, in the PDP according to the second embodiment, a plurality of non-discharge regions 36 and a plurality of discharge cells 37R, 37G, and 37B are defined by barrier ribs 35. Non-discharge regions 36 are formed in areas encompassed by discharge cell abscissas and ordinates that pass through centers of each of the discharge cells 37R, 37G, and 37B, and that are aligned respectively with directions X and Y as in the first embodiment.

Ends of discharge cells 37R, 37G, and 37B are formed reducing in width in the direction of discharge sustain electrodes 17 and 18 (direction Y) as a distance from a center of each of the discharge cells 27R, 27G, and 27B is increased in the direction that address electrodes 21 are provided (direction X). Such a configuration is continued until reaching a point of minimal width such that the ends of discharge cells 37R, 37G, and 37B are wedge-shaped. Therefore, discharge cells 37R, 37G, and 37B have an overall planar shape of a hexagon.

Discharge sustain electrodes 17 and 18 include bus electrodes 17*b* and 18*b*, respectively, that are formed along a direction (direction Y) that is substantially perpendicular to the direction address electrodes 21 are formed (direction X), and protrusion electrodes 17*a* and 18*a*, respectively. For each row of discharge cells 37R, 37G, and 37B along direction Y, bus electrodes 17*b* are extended in the same direction overlapping one end of discharge cells 37R, 37G, and 37B, and bus electrodes 18*b* are extended overlapping an opposite end of discharge cells 37R, 37G, and 37B. Therefore, each of the discharge cells 37R, 37G, and 37B has one of the bus electrodes 17*b* positioned over one end, and one of the bus electrodes 18*b* positioned over its other end.

Further, for each row of discharge cells 37R, 37G, and 37B along direction Y, protrusion electrodes 17*a* overlap and protrude from corresponding bus electrode 17*b* into the area of discharge cells 37R, 37G, and 37B. Protrusion electrodes 18*a* overlap and protrude from corresponding bus electrode 18*b* into the area of discharge cells 37R, 37G, and 37B. Therefore, one protrusion electrode 17*a* and one protrusion electrode 18*a* are formed opposing one another in each area corresponding to each of the discharge cells 37R, 37G, and 37B.

Proximal ends of protrusion electrodes 17*a* and 18*a* (i.e., where protrusion electrodes 17*a* and 18*a* are attached to and extended from bus electrodes 17*b* and 18*b*, respectively) are formed corresponding to the wedge shape of the ends of discharge cells 37R, 37G, and 37B.

Figure 6:
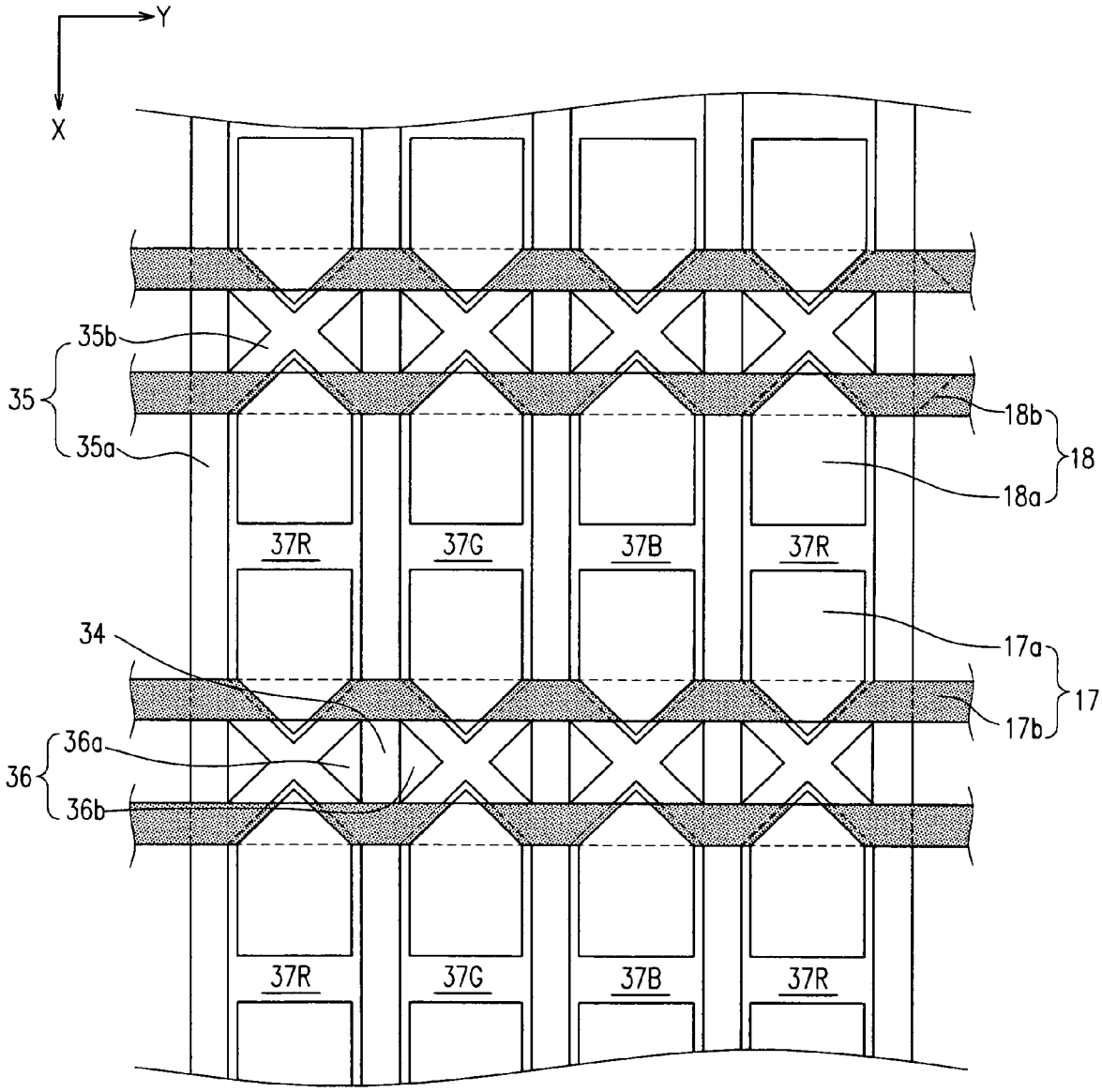
FIG. 6 is a partial plan view of a modified example of the plasma display panel of FIG. 5.

FIG. 6 is a partial plan view of a modified example of the plasma display panel of FIG. 5.

Partition barrier ribs 34 are formed in direction X passing through centers of non-discharge regions 36. Partition barrier ribs 34 may be formed by extending first barrier rib members 35*a* of barrier ribs 35. With the formation of partition barrier ribs 34, non-discharge regions 36 are divided into two sections 36*a* and 36*b*. It should be noted that non-discharge regions 36 may be divided into more than two sections depending on the number and formation of partition barrier ribs 34.

Figure 7:
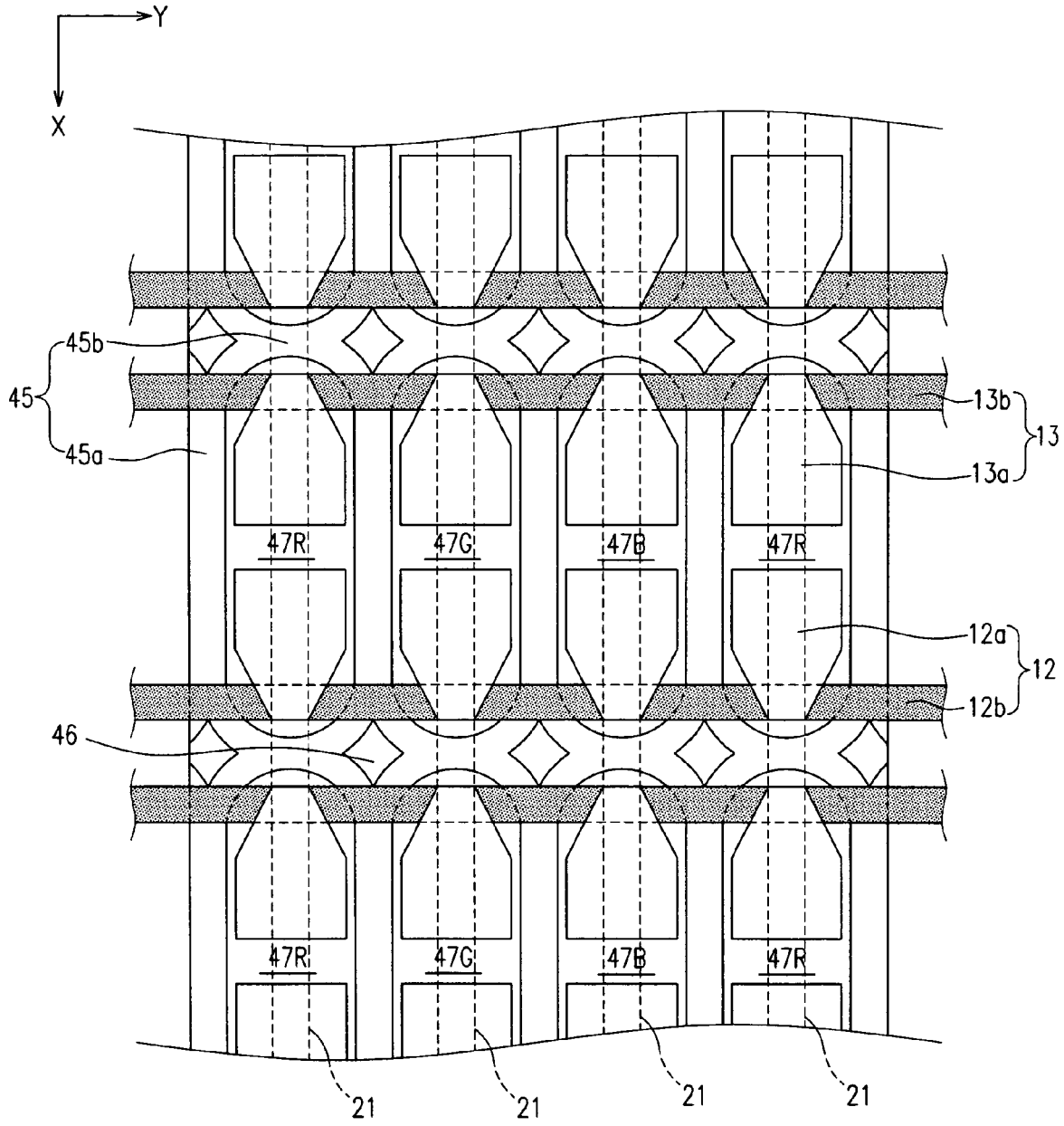
FIG. 7 is a partial plan view of a plasma display panel according to a third embodiment of the present invention.

FIG. 7 is a partial plan view of a plasma display panel according to a third embodiment of the present invention.

As shown in the drawing, in the PDP according to the third embodiment, a plurality of non-discharge regions 46 and a plurality of discharge cells 47R, 47G, and 47B are defined by barrier ribs 45. Non-discharge regions 46 are formed in areas encompassed by discharge cell abscissas and ordinates that pass through centers of each of the discharge cells 47R, 47G, and 47B, and that are aligned respectively with directions X and Y as in the first embodiment. With lengths of discharge cells 47R, 47G, and 47B being provided along a direction of address electrodes 21 (direction X), ends of discharge cells 47R, 47G, and 47B are rounded into an arc shape.

Discharge sustain electrodes 12 and 13 include bus electrodes 12*b* and 13*b*, respectively, that are formed along a direction (direction Y) that is substantially perpendicular to the direction address electrodes 21 are formed (direction X), and protrusion electrodes 12*a* and 13*a*, respectively. For each row of discharge cells 47R, 47G, and 47B along direction Y, bus electrodes 12*b* are extended in the same direction overlapping one end of discharge cells 47R, 47G, and 47B, and bus electrodes 13*b* are extended overlapping an opposite end of the discharge cells 47R, 47G, and 47B. Therefore, each of the discharge cells 47R, 47G, and 47B has one of the bus electrodes 12*b* positioned over one end, and one of the bus electrodes 13*b* positioned over its other end.

Further, for each row of discharge cells 47R, 47G, and 47B along direction Y, protrusion electrodes 12*a* overlap and protrude from corresponding bus electrode 12*b* into the area of discharge cells 47R, 47G, and 47B; and protrusion electrodes 13*a* overlap and protrude from corresponding bus electrode 13*b* into the area of discharge cells 47R, 47G, and 47B. Therefore, one protrusion electrode 12*a* and one protrusion electrode 13*a* are formed opposing one another in each area corresponding to each of the discharge cells 47R, 47G, and 47B.

Proximal ends of protrusion electrodes 12*a* and 13*a* (i.e., where protrusion electrodes 12*a* and 13*a* are attached to and extended from bus electrodes 12*b* and 13*b*, respectively) are formed in a wedge-shape configuration. That is, the proximal ends of protrusion electrodes 12*a* and 13*a* reduce in width along direction Y as the distance from the center of discharge cells 47R, 47G, and 47B along direction X is increased to thereby realize their wedge shape.

Figure 8:
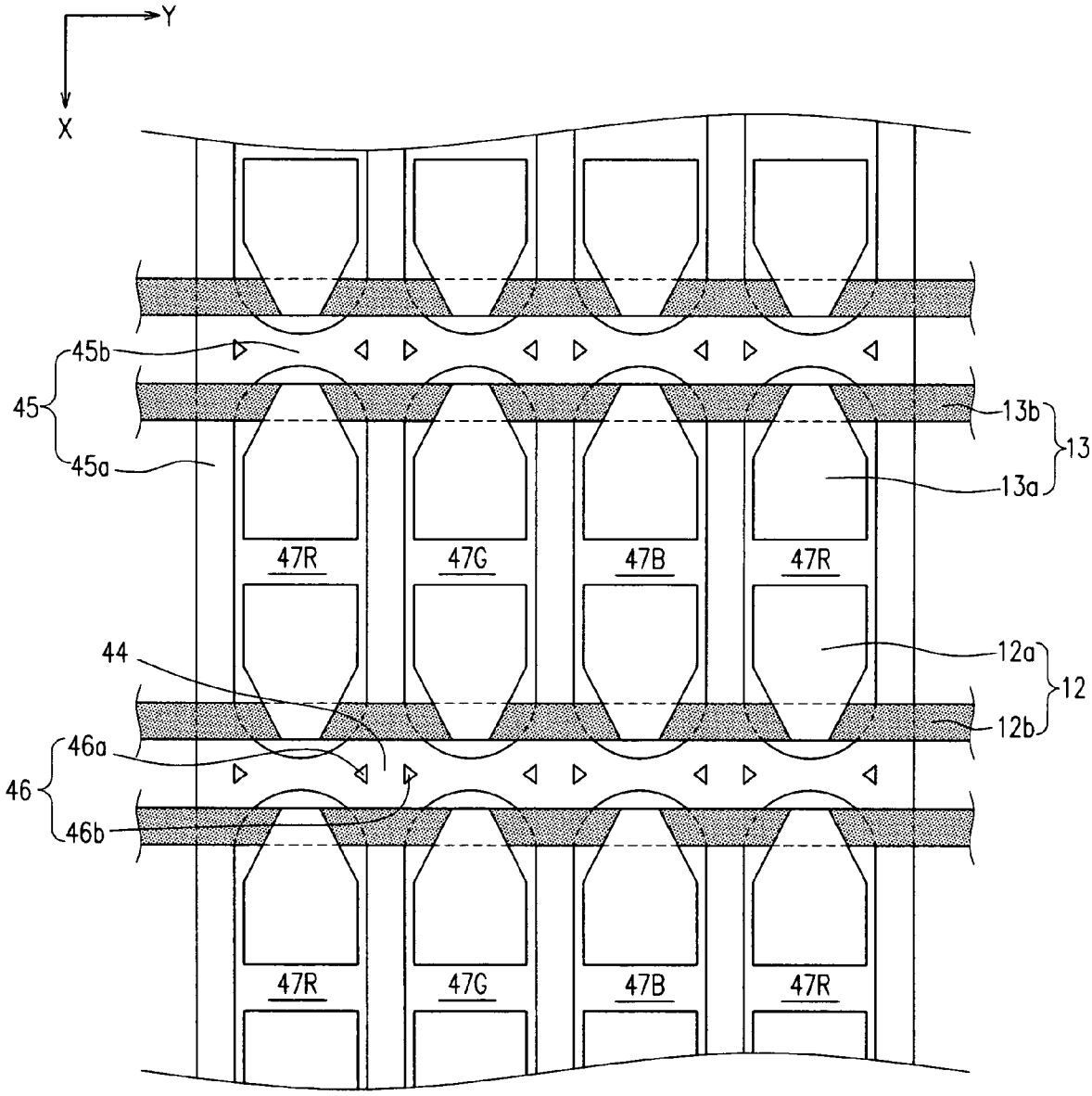
FIG. 8 is a partial plan view of a modified example of the plasma display panel of FIG. 7.

FIG. 8 is a partial plan view of a modified example of the plasma display panel of FIG. 7.

Partition barrier ribs 44 are formed in direction X passing through centers of non-discharge regions 46. Partition barrier ribs 44 may be formed by extending first barrier rib members 45*a* of barrier ribs 45. With the formation of partition barrier ribs 44, non-discharge regions 46 are divided into two sections 46*a* and 46*b*. It should be noted that non-discharge regions 46 may be divided into more than two sections depending on the number and formation of partition barrier ribs 44.

Figure 9:
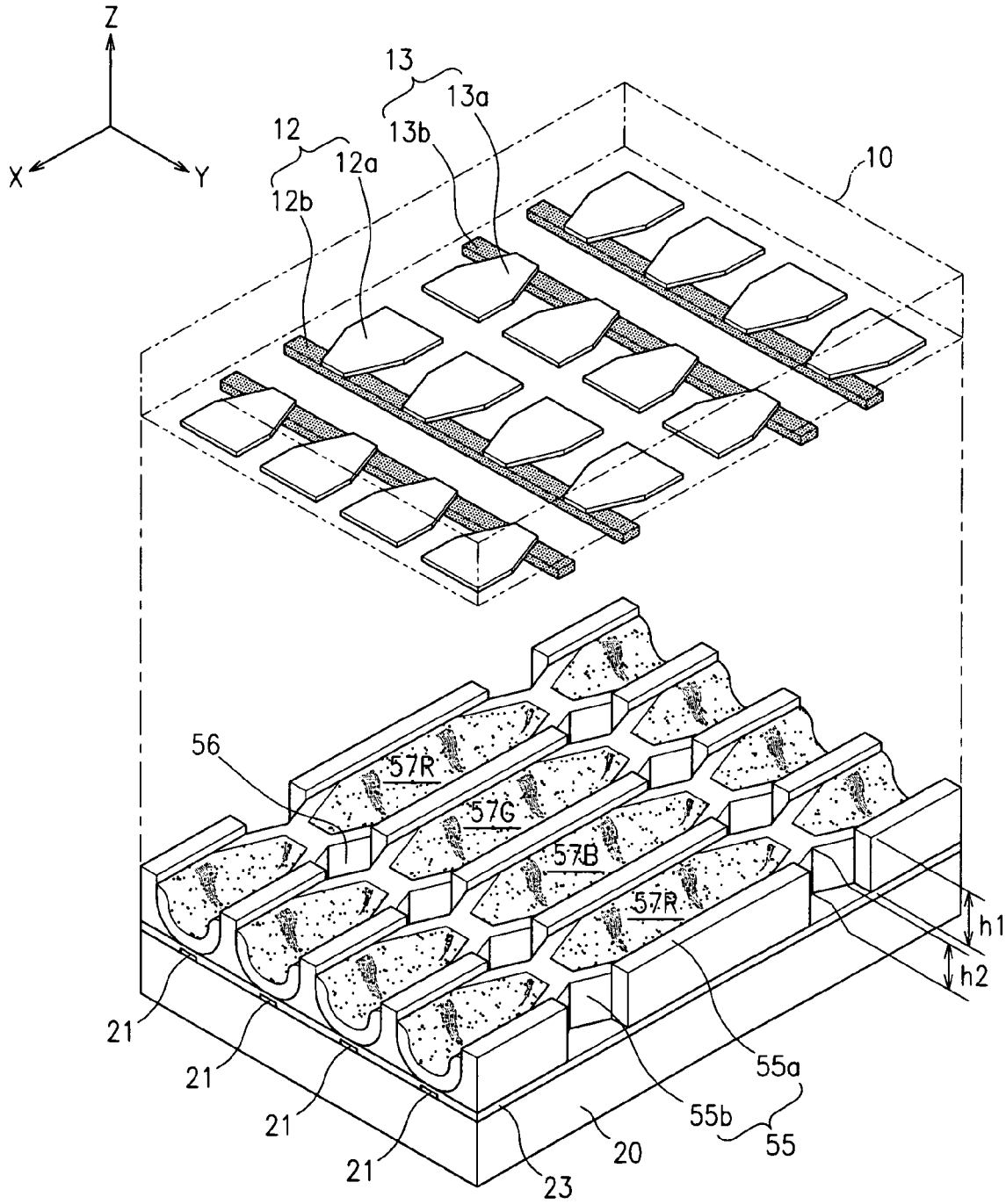
FIG. 9 is a partial exploded perspective view of a plasma display panel according to a fourth embodiment of the present invention.
Figure 10:
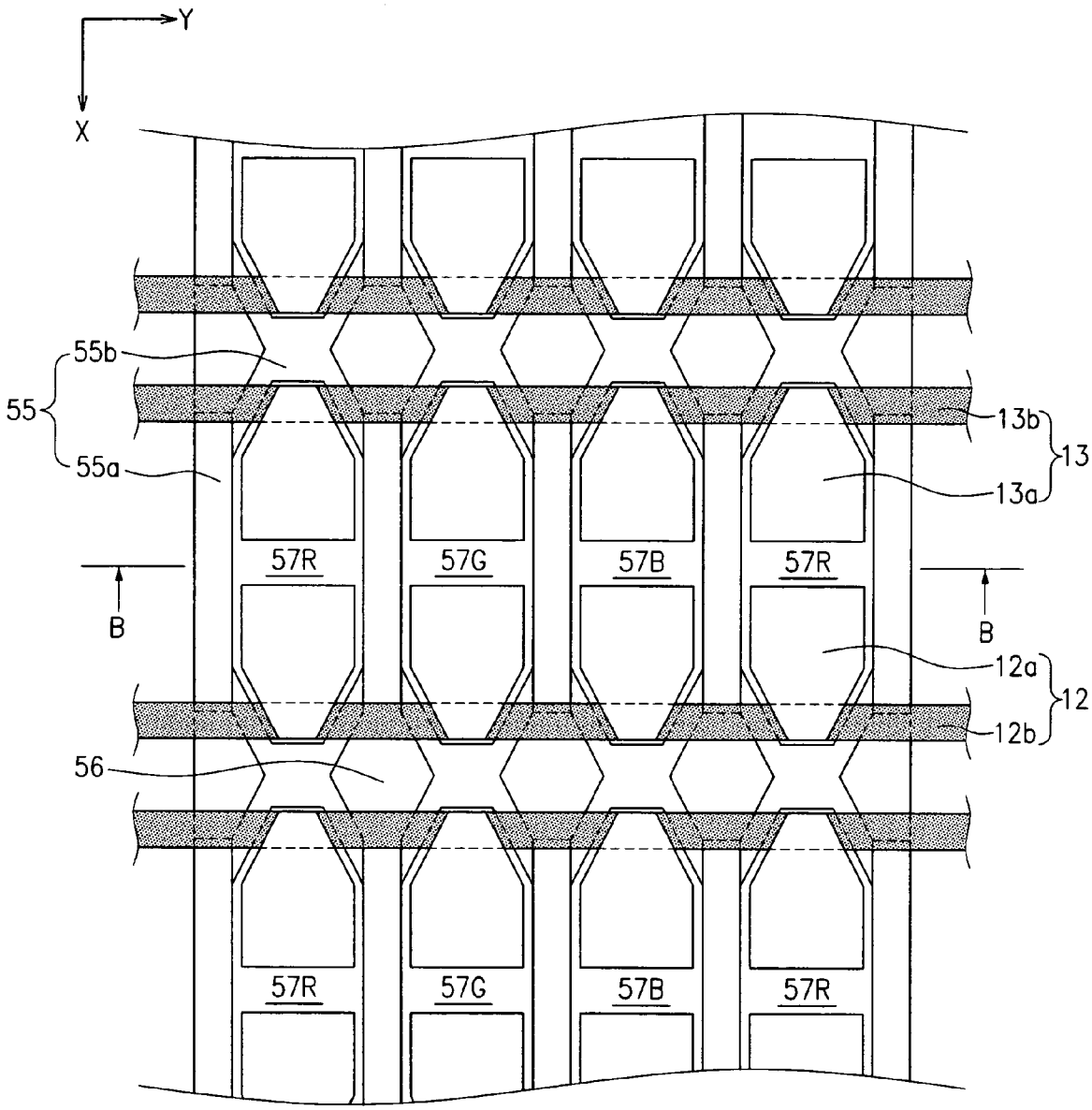
FIG. 10 is a partial plan view of the plasma display panel of FIG. 9.
Figure 11:
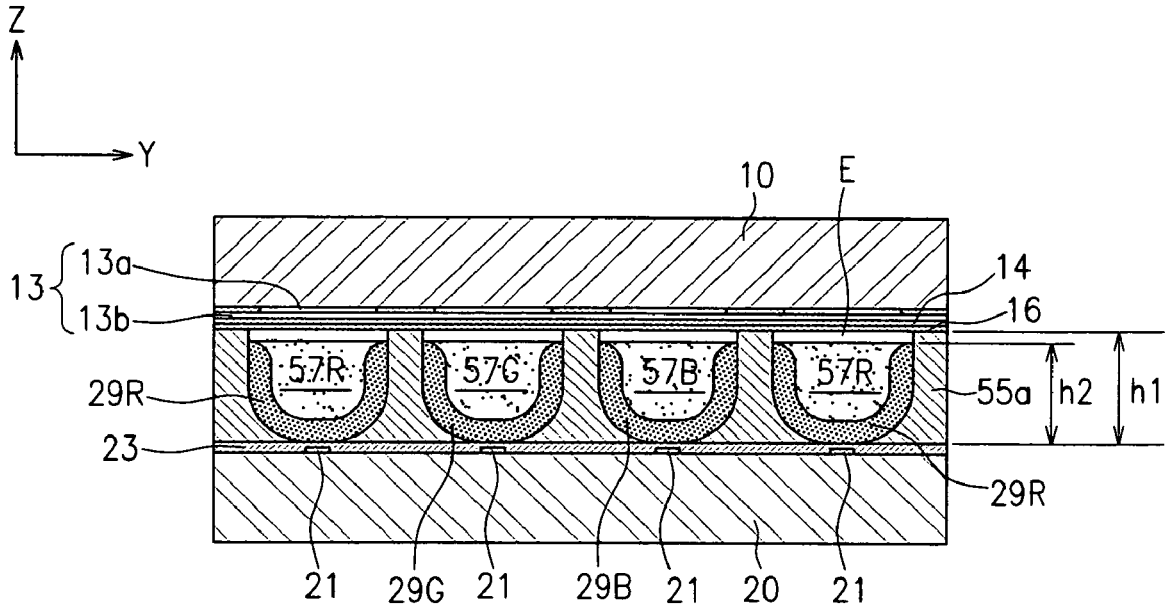
FIG. 11 is a sectional view taken along line B—B of FIG. 10.

FIG. 9 is a sectional exploded perspective view of a plasma display panel according to a fourth embodiment of the present invention, FIG. 10 is a partial plan view of the plasma display panel of FIG. 9, and FIG. 11 is a sectional view taken along line B—B of FIG. 10. In the plasma display panel (PDP) according to the fourth embodiment, barrier ribs 55 that define non-discharge regions 56 and discharge cells 57R, 57G, and 57B include first barrier rib members 55*a* that are parallel to address electrodes 21, and second barrier rib members 55*b* that define ends of discharge cells 57R, 57G, and 57B, are not parallel to address electrodes 21, and intersect over address electrodes 21. Second barrier rib members 55*b* are formed in substantially an X shape between discharge cells 57R, 57G, and 57B that are adjacent in the direction the address electrodes are formed (direction X). Each of the non-discharge regions 56 is defined by a pair of second barrier rib members 55*b* adjacent in the direction discharge sustain electrodes 12 and 13 are formed (direction Y), and by a pair of first barrier rib members 55*a* adjacent in the direction address electrodes 21 are formed (direction X). Non-discharge regions 56 are therefore formed into independent cell structures.

Further, first barrier rib members 55*a* and second barrier rib members 55*b* forming barrier ribs 55 may have different heights. In the fourth embodiment, height h1 of first barrier rib members 55*a* is greater than a height h2 of second barrier rib members 55*b*. As a result, with reference to FIG. 11, exhaust spaces E are formed between first substrate 10 and second substrate 20 to thereby enable more effective and smoother evacuation of the PDP during manufacture. It is also possible for height h1 of first barrier rib members 55*a* to be less than height h2 of second barrier rib members 55*b*.

All other aspects of the fourth embodiment such as the shape of discharge cells 57R, 57G, and 57B, and/or of discharge sustain electrodes 12 and 13, and the positioning of discharge cells 57R, 57G, and 57B relative to non-discharge regions 56 are identical to the first embodiment.

Figure 12:
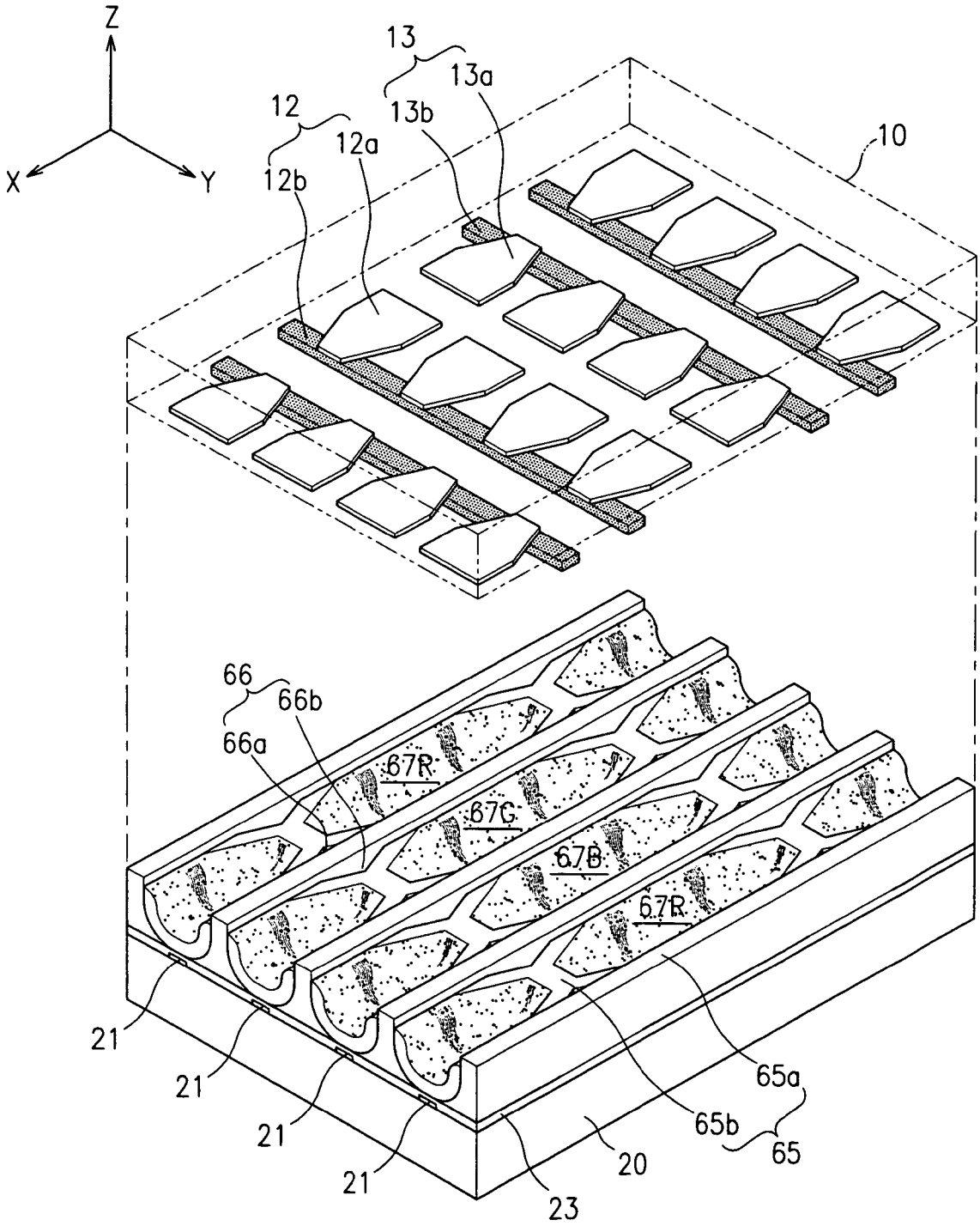
FIG. 12 is a partial exploded perspective view of a plasma display panel according to a fifth embodiment of the present invention.

FIG. 12 is a sectional exploded perspective view of a plasma display panel according to a fifth embodiment of the present invention. In the plasma display panel (PDP) according to the fifth embodiment, barrier ribs 65 that define non-discharge regions 66 and discharge cells 67R, 67G, and 67B include first barrier rib members 65*a* that are parallel to address electrodes 21, and second barrier rib members 65*b* that define ends of discharge cells 67R, 67G, and 67B, are not parallel to address electrodes 21, and intersect over address electrodes 21. First barrier rib members 65*a* are formed in a striped pattern in the direction address electrodes 21 are formed, and each extend a length of the PDP in the same direction. Second barrier rib members 65*b* are formed in substantially an X shape between discharge cells 67R, 67G, and 67B that are adjacent in the direction the address electrodes are formed (direction X). Each of the non-discharge regions 66, including sections 66*a* and 66*b*, is defined by a pair of second barrier rib members 65*b* adjacent in the direction discharge sustain electrodes 12 and 13 are formed (direction Y), and by one of the first barrier rib members 65*a*, which pass through centers of non-discharge regions 66 in the direction address electrodes 21 are formed (direction X).

Further, first barrier rib members 65*a* and second barrier rib members 65*b* forming barrier ribs 65 may have different heights. In the fifth embodiment, a height of first barrier rib members 65*a* is greater than a height of second barrier rib members 65*b*. This allows for more effective and smoother evacuation of the PDP during manufacture. It is also possible for the height of first barrier rib members 65*a* to be less than the height of second barrier rib members 65*b*.

All other aspects of the fifth embodiment such as the shape of discharge cells 67R, 67G, and 67B, and/or of discharge sustain electrodes 12 and 13, and the positioning of discharge cells 67R, 67G, and 67B relative to non-discharge regions 66 are identical to the first embodiment.

Figure 13:
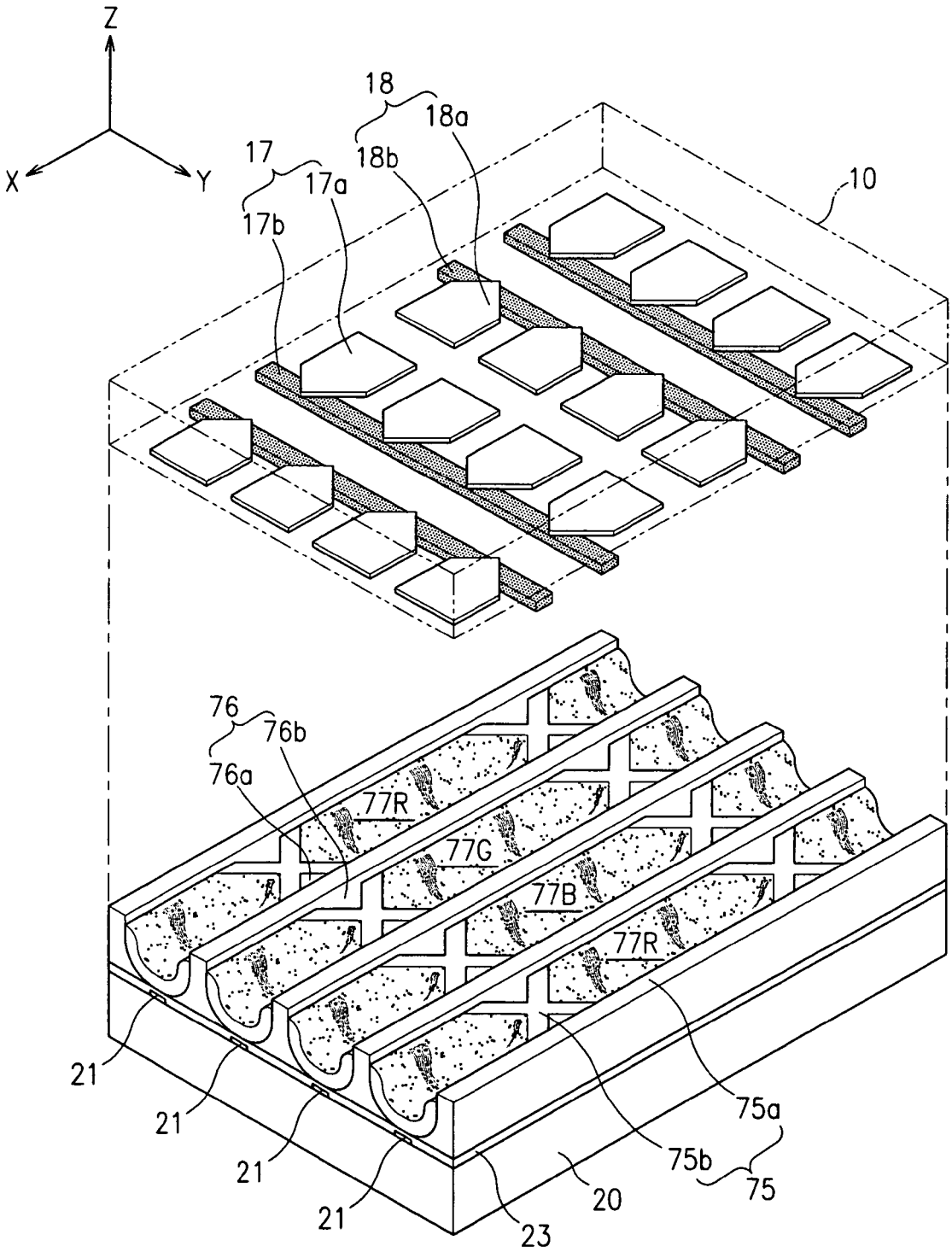
FIG. 13 is a partial exploded perspective view of a plasma display panel according to a sixth embodiment of the present invention.

FIG. 13 is a sectional exploded perspective view of a plasma display panel according to a sixth embodiment of the present invention. In the plasma display panel (PDP) according to the sixth embodiment, barrier ribs 75 that define non-discharge regions 76 and discharge cells 77R, 77G, and 77B include first barrier rib members 75*a* that are parallel to address electrodes 21, and second barrier rib members 75*b* that define ends of discharge cells 77R, 77G, and 77B, are not parallel to address electrodes 21, and intersect over address electrodes 21. First barrier rib members 75*a* are formed in a striped pattern in the direction address electrodes 21 are formed, and each extend a length of the PDP in the same direction. Second barrier rib members 75*b* are formed in substantially an X shape between discharge cells 77R, 77G, and 77B that are adjacent in the direction the address electrodes are formed (direction X). Each of the non-discharge regions 76 is defined by a pair of second barrier rib members 75*b* adjacent in the direction discharge sustain electrodes 12 and 13 are formed (direction Y), and by one of the first barrier rib members 75*a*, which pass through centers of non-discharge regions 76 in the direction address electrodes 21 are formed (direction X).

Further, first barrier rib members 75*a* and second barrier rib members 75*b* forming barrier ribs 75 may be formed have different heights. In the sixth embodiment, a height of first barrier rib members 75*a* is greater than a height of second barrier rib members 75*b*. This allows for more effective and smoother evacuation of the PDP during manufacture. It is also possible for the height of first barrier rib members 75*a* to be less than the height of second barrier rib members 75*b*.

All other aspects of the sixth embodiment such as the shape of discharge cells 77R, 77G, and 77B, and/or of discharge sustain electrodes 12 and 13, and the positioning of discharge cells 77R, 77G, and 77B relative to non-discharge regions 76 are identical to the second embodiment.

Figure 14:
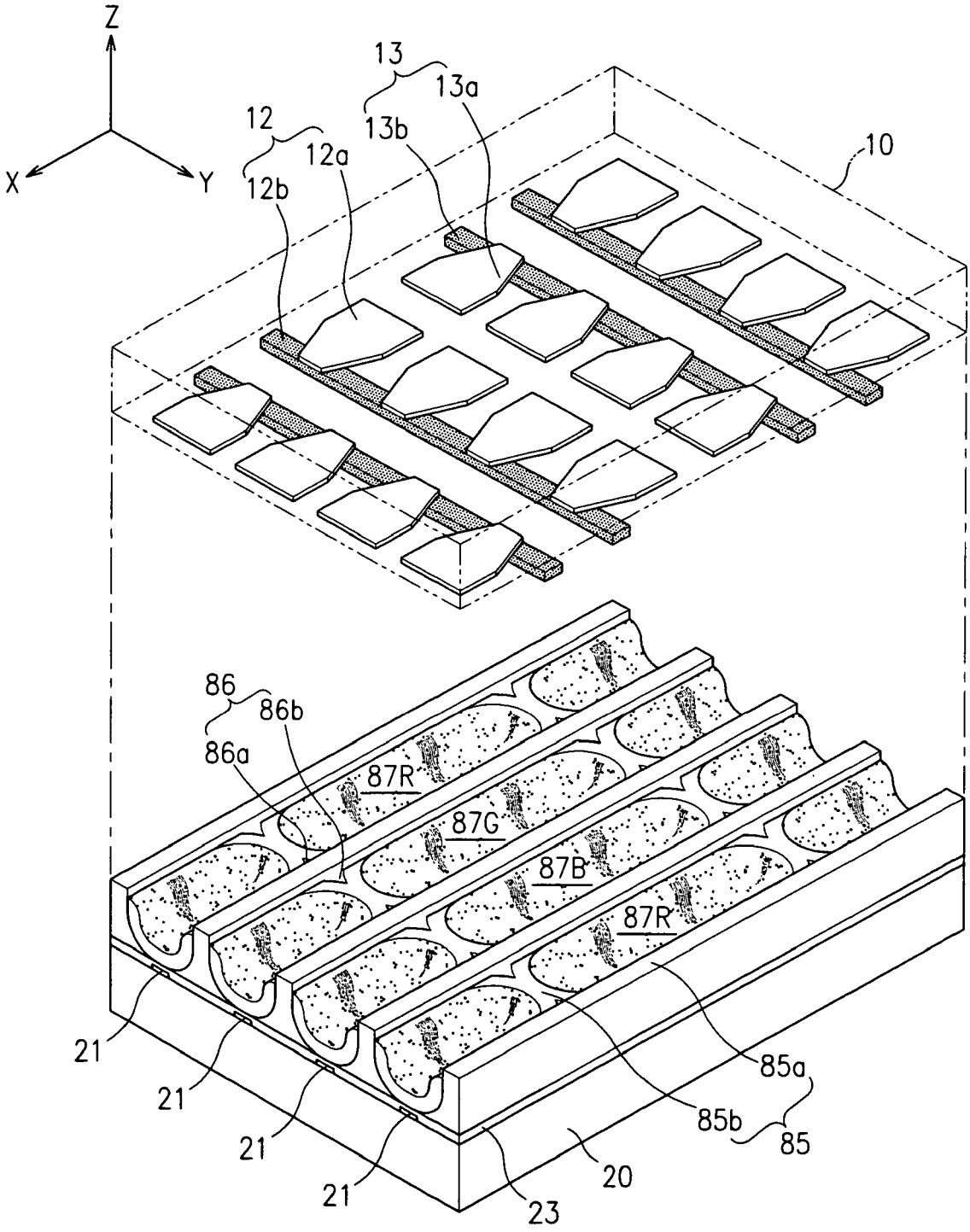
FIG. 14 is a partial exploded perspective view of a plasma display panel according to a seventh embodiment of the present invention.

FIG. 14 is a sectional exploded perspective view of a plasma display panel according to a seventh embodiment of the present invention. In the plasma display panel (PDP) according to the seventh embodiment, barrier ribs 85 that define non-discharge regions 86, including sections 86*a* and 86*b*, and discharge cells 87R, 87G, and 87B include first barrier rib members 85*a* that are parallel to address electrodes 21, and second barrier rib members 85*b* that define ends of discharge cells 87R, 87G, and 87B, are not parallel to address electrodes 21, and intersect over address electrodes 21. First barrier rib members 85*a* are formed in a striped pattern in the direction address electrodes 21 are formed, and each extend a length of the PDP in the same direction. Second barrier rib members 85*b* are formed in substantially an X shape between discharge cells 87R, 87G, and 87B that are adjacent in the direction the address electrodes are formed (direction X). Each of the non-discharge regions 86 is defined by a pair of second barrier rib members 85*b* adjacent in the direction discharge sustain electrodes 12 and 13 are formed (direction Y), and by one of the first barrier rib members 85*a*, which pass through centers of non-discharge regions 86 in the direction address electrodes 21 are formed (direction X).

Further, first barrier rib members 85*a* and second barrier rib members 85*b* forming barrier ribs 85 may have different heights. In the seventh embodiment, a height of first barrier rib members 85*a* is greater than a height of second barrier rib members 85*b*. This allows for more effective and smoother evacuation of the PDP during manufacture. It is also possible for the height of first barrier rib members 85*a* to be less than the height of second barrier rib members 85*b*.

All other aspects of the seventh embodiment such as the shape of discharge cells 87R, 87G, and 87B, and/or of discharge sustain electrodes 12 and 13, and the positioning of discharge cells 87R, 87G, and 87B relative to non-discharge regions 86 are identical to the third embodiment.

Figure 15:
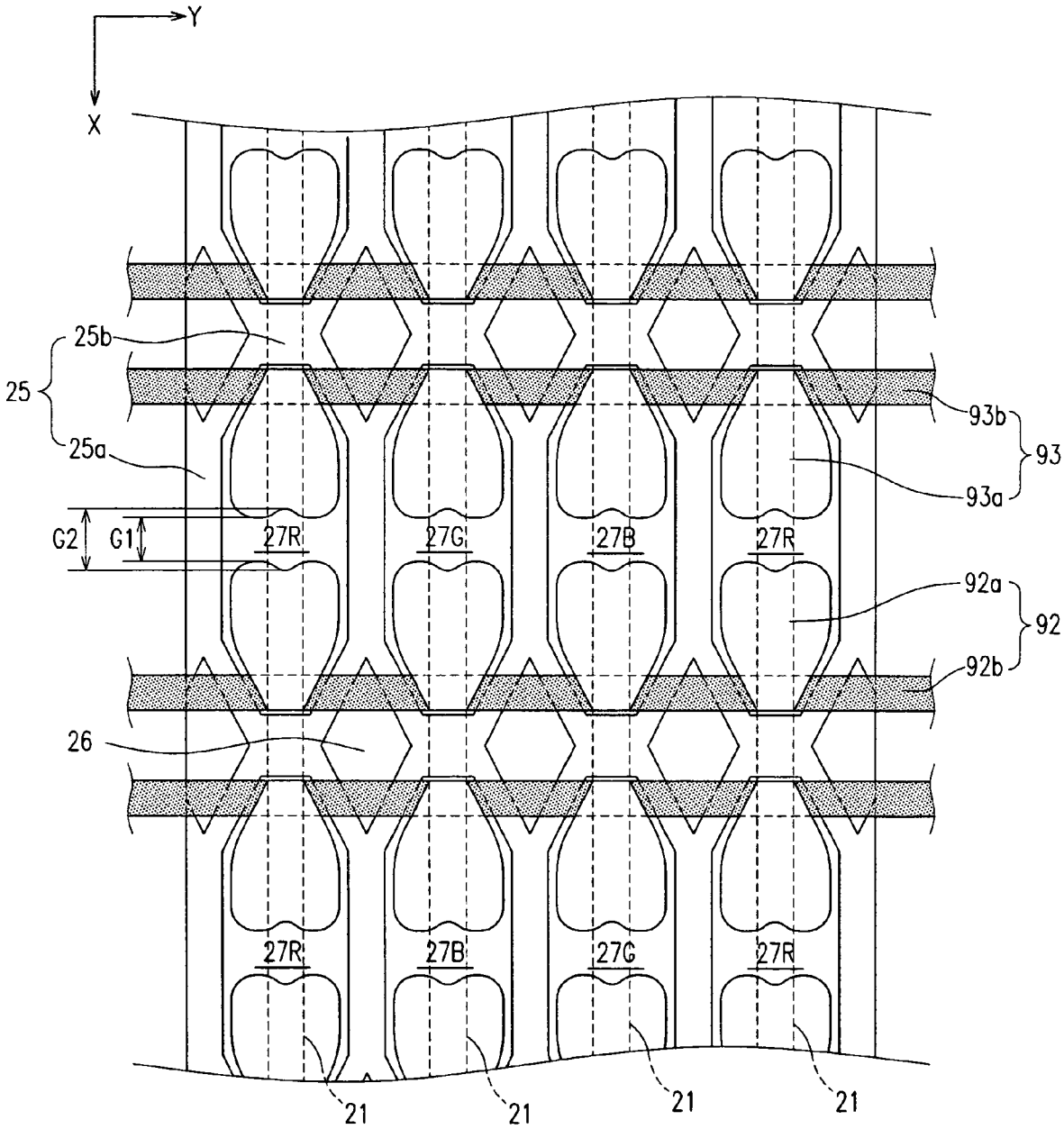
FIG. 15 is a partial plan view of a plasma display panel according to an eighth embodiment of the present invention.
Figure 16:
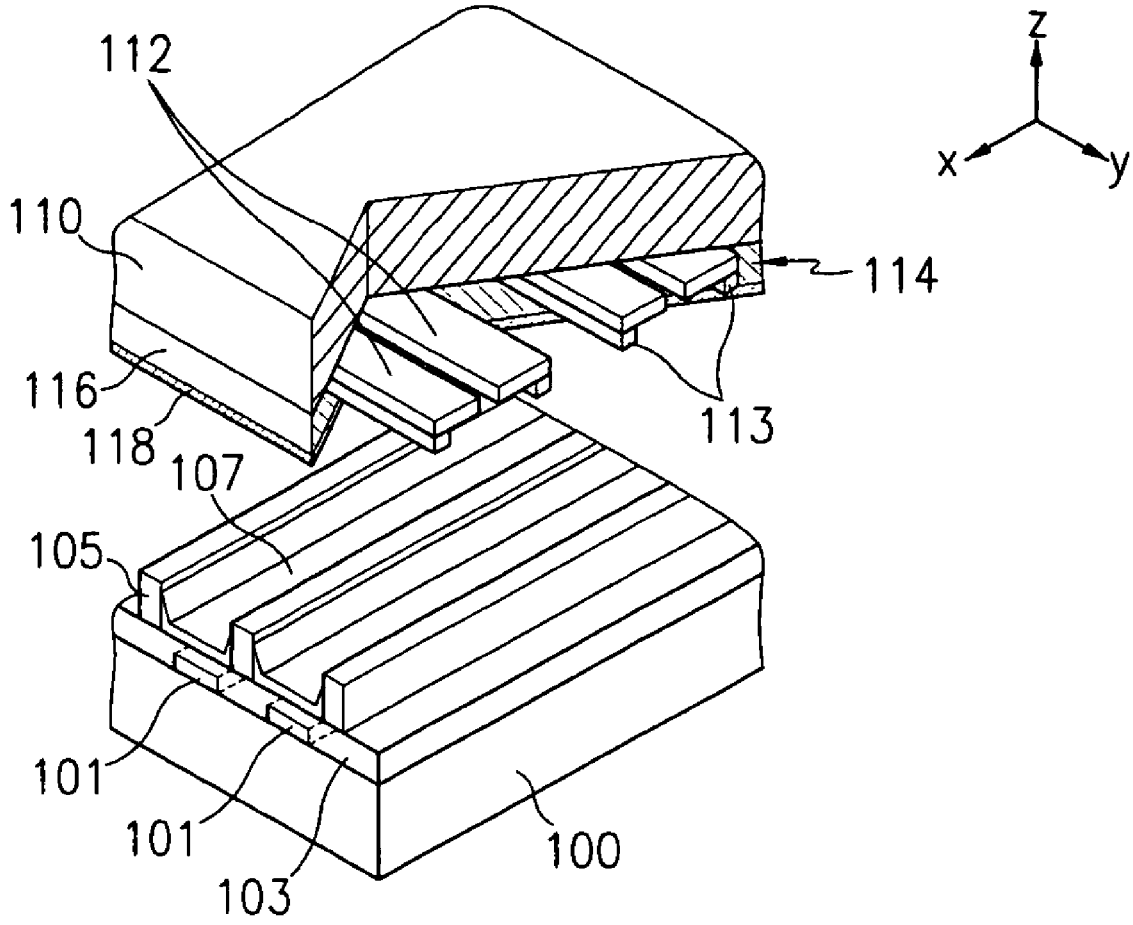
FIG.16(PRIOR ART)
FIG. 16 is a partially cutaway perspective view of a conventional plasma display panel.
Figure 17:
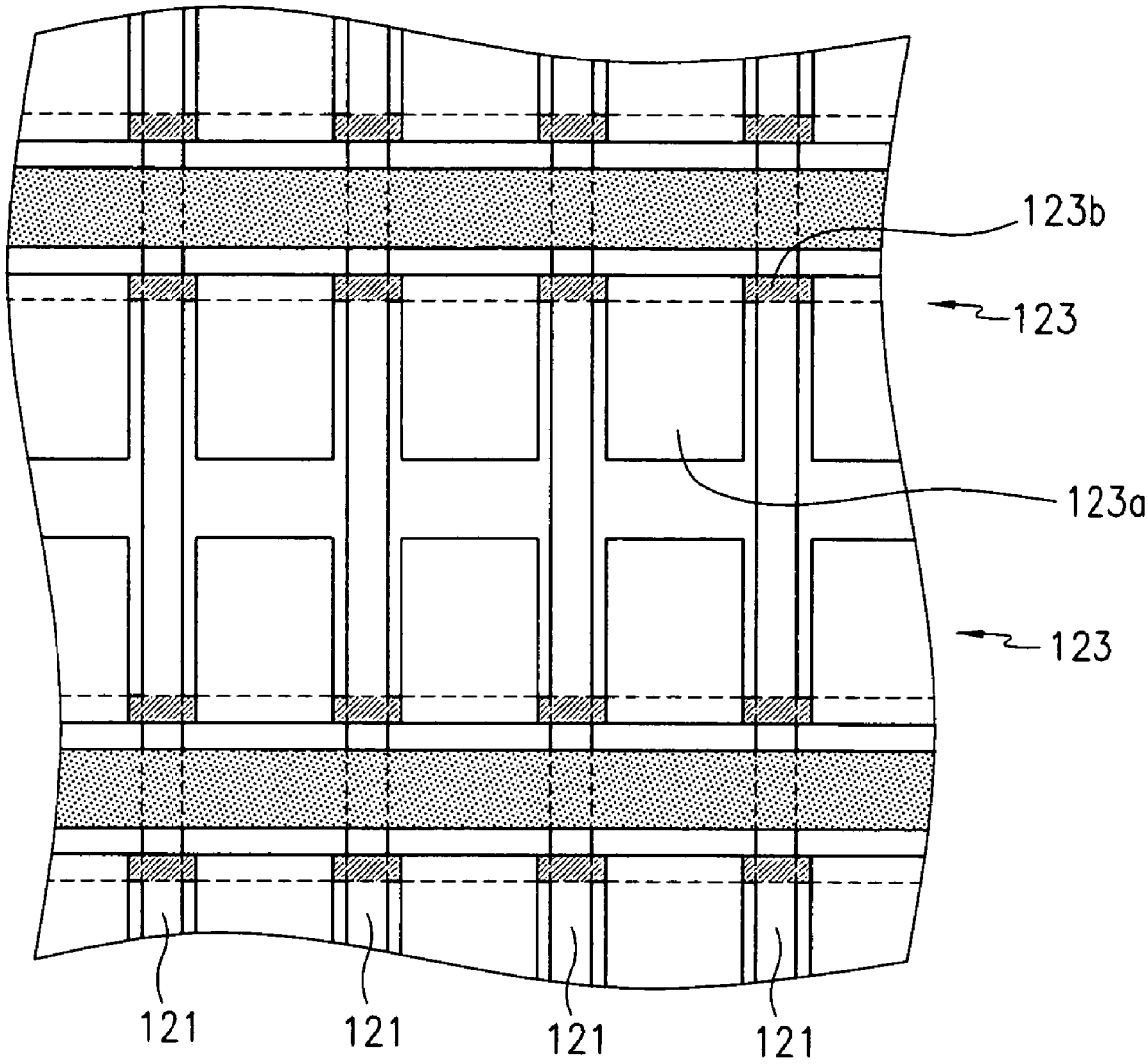
FIG.17(PRIOR ART)
FIG. 17 is a partial plan view of a conventional plasma display panel having a striped barrier rib structure.
Figure 18:
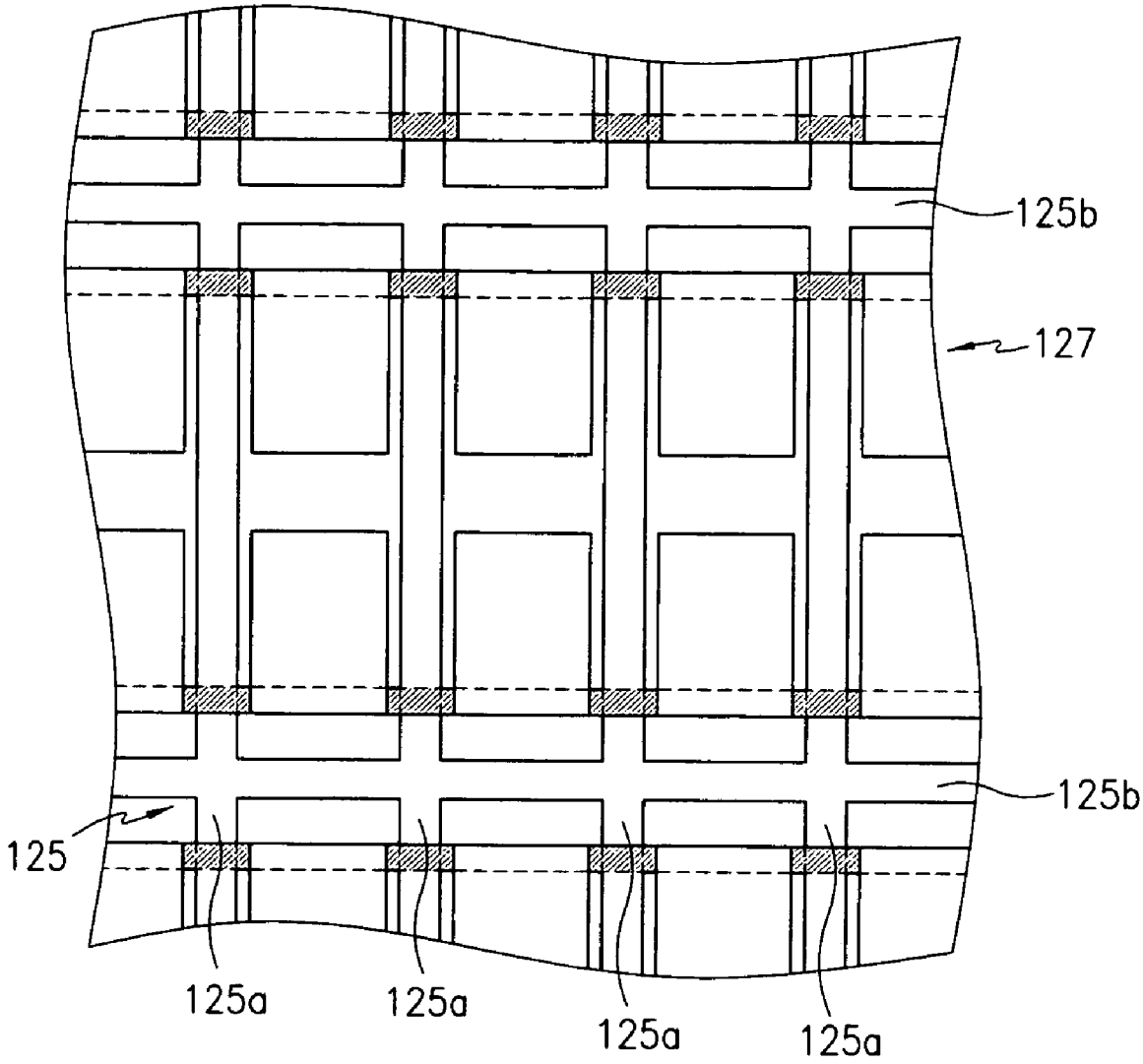
FIG.18(PRIOR ART)
FIG. 18 is a partial plan view of a conventional plasma display panel having a matrix barrier rib structure.

FIG. 15 is a sectional exploded perspective view of a plasma display panel according to an eighth embodiment of the present invention. In the plasma display panel (PDP) according to the eighth embodiment, discharge sustain electrodes 92 and 93 include respectively bus electrodes 92*b* and 93*b* that are formed along a direction substantially perpendicular to a direction address electrodes 21 are formed, and include respectively protrusion electrodes 92*a* and 93*a* that extend from bus electrodes 92*b* and 93*b*, respectively, into areas corresponding to discharge cells 27R, 27G, and 27B.

Distal ends of protrusion electrodes 92*a* and 93*a* are formed such that center areas along direction Y are indented and sections to both sides of the indentations are protruded. Therefore, in each of the discharge cells 27R, 27G, and 27B, one of the protrusion electrodes 92*a* opposes one of the protrusion electrodes 93*a* with a gap therebetween varying as a result of the indentations and protrusions at the distal ends of protrusion electrodes 92*a* and 93*a*. This results in a long gap being formed where the indentations of protrusion electrodes 92*a* and 93*a* oppose one another, and short gaps being formed where the protrusions of protrusion electrodes 92*a* and 93*a* oppose one another. Accordingly, plasma discharge, which initially occurs in the short gaps between opposing protrusion electrodes 92*a* and 93*a*, is more efficiently diffused such that overall discharge efficiency is increased.

The distal ends of protrusion electrodes 92*a* and 93*a* may be formed with only indented center areas such that protruded sections are formed to both sides of the indentations, or may be formed with the protrusions to both sides of the indentations extending past a reference straight line r formed along direction Y. Further, protrusion electrodes 92*a* and 93*a* providing the pair of the same positioned within each of the discharge cells 27R, 27G, and 27B may be formed as described above, or only one of the pair may be formed with the indentations and protrusions. Regardless of the particular configuration used, in one embodiment edges of the indentations and protrusions of protrusion electrodes 92*a* and 93*a* be rounded with no abrupt changes in angle.

All other aspects of the eighth embodiment such as the shape of discharge cells 27R, 27G, and 27B, and the positioning of discharge cells 27R, 27G, and 27B relative to non-discharge regions 26 are identical to the first embodiment.

In the PDP of the present invention described above, non-discharge regions are formed between discharge cells, the discharge cells are formed to maximize discharge efficiency, and the phosphor layers are formed closer to the discharge sustain electrodes to realize improved efficiency in converting vacuum ultraviolet rays to visible light.

In addition, each of the discharge cells is formed into independent spaces so that crosstalk between adjacent discharge cells is prevented. Also, the first barrier rib members, which are aligned with the address electrodes, and the second barrier rib members, which intersect over the address electrodes, are formed to different heights to thereby allow smooth and efficient evacuation of the PDP during manufacture.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, and wherein at least one non-discharge region separates at least one pair of diagonally-adjacent discharge regions.

2. The plasma display panel of claim 1, wherein the non-discharge regions are respectively centered between the discharge cell abscissas that pass through centers of adjacent discharge cells and the discharge cell ordinates that pass through centers of adjacent discharge cells.

3. The plasma display panel of claim 1, wherein the barrier ribs both separate adjacent discharge cells and form the non-discharge regions as cell structures.

4. The plasma display panel of claim 3, wherein the cell structures separate diagonally-adjacent discharge cells.

5. The plasma display panel of claim 1, wherein a non-discharge region is divided into a plurality of non-discharge sub-regions by at least one partition barrier rib located within the non-discharge region.

6. The plasma display panel of claim 1, wherein pairs of the discharge cells adjacent in a direction the discharge sustain electrodes are formed share at least one barrier rib.

7. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, and wherein at least one non-discharge region separates at least one pair of diagonally-adjacent discharge regions.

8. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, wherein both ends of each of the discharge cells along a direction the address electrodes are formed have an increasingly decreasing depth as a distance from a center of the discharge cells is increased, the depths being measured from an end of the barrier ribs adjacent to the first substrate in a direction toward the second substrate.

9. The plasma display panel of claim 7, wherein both ends of each of the discharge cells along a direction the address electrodes are formed have a configuration substantially in the shape of a trapezoid.

10. The plasma display panel of claim 7, wherein both ends of each of the discharge cells along a direction the address electrodes are formed are substantially wedge-shaped.

11. The plasma display panel of claim 7, wherein both ends of each of the discharge cells along a direction the address electrodes are formed are substantially arc-shaped.

12. The plasma display panel of claim 7, wherein baffler ribs shared by each pair of discharge cells adjacent along a direction the discharge sustain electrodes are formed in parallel.

13. A plasma display panel, comprising:

a first substrate and a second substrate provided opposing one another with a predetermined gap therebetween;

address electrodes formed on the second substrate;

barrier ribs mounted between the first substrate and the second substrate, the baffler ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein the barrier ribs forming the discharge cells include first baffler rib members, which are parallel to a direction the address electrodes are formed, and second barrier rib members, which are not parallel to the direction the address electrodes are formed, and wherein at least one non-discharge region separates at least one pair of diagonally-adjacent discharge regions.

14. The plasma display panel of claim 13, wherein the second barrier rib members intersect at the direction the address electrodes are formed.

15. The plasma display panel of claim 13, wherein the first barrier rib members and second baffler rib members have different heights.

16. The plasma display panel of claim 15, wherein the first baffler rib members is higher than the second baffler rib members.

17. The plasma display panel of claim 15, wherein the first baffler rib members is lower than the second baffler rib members.

18. A plasma display panel, comprising:

a first substrate and a second substrate provided opposing one another with a predetermined gap therebetween;

address electrodes formed on the second substrate;

baffler ribs mounted between the first substrate and the second substrate, the baffler ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, wherein the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell, and wherein at least one non-discharge region separates at least one pair of diagonally-adjacent discharge regions.

19. The plasma display panel of claim 18, wherein proximal ends of the protrusion electrodes where the protrusion electrodes are connected to and extend from the bus electrodes decrease in width in the direction the bus electrodes are formed as the distance from the center of the discharge cells is increased.

20. The plasma display panel of claim 19, wherein the proximal ends of the protrusion electrodes are formed corresponding to the shape of the ends of the discharge cells.

21. A plasma display panel, comprising:

a first substrate and a second substrate provided opposing one another with a predetermined gap therebetween;

address electrodes formed on the second substrate;

barrier ribs mounted between the first substrate and the second substrate, the barrier ribs defining a plurality of discharge cells and a plurality of non-discharge regions;

phosphor layers formed within each of the discharge cells; and discharge sustain electrodes formed on the first substrate, wherein the non-discharge regions are formed in areas encompassed by discharge cell abscissas that pass through centers of adjacent discharge cells and discharge cell ordinates that pass through centers of adjacent discharge cells, wherein each of the discharge cells is formed such that ends of the discharge cells gradually decrease in width along a direction the discharge sustain electrodes are formed as a distance from a center of the discharge cells is increased along a direction the address electrodes are formed, wherein the discharge sustain electrodes include bus electrodes that extend such that a pair of the bus electrodes is provided for each of the discharge cells, and protrusion electrodes formed extending from each of the bus electrodes such that a pair of opposing protrusion electrodes is formed within areas corresponding to each discharge cell, wherein a distal end of each of the protrusion electrodes opposite proximal ends connected to and extended from the bus electrodes is formed including an indentation.

22. The plasma display panel of claim 21, wherein the indentation is formed substantially in a center of the distal ends of each of the protrusion electrodes along the direction the bus electrodes are formed.

23. The plasma display panel of claim 21, wherein a protrusion is formed to both sides of the indentations of each of the protrusion electrodes.

24. The plasma display panel of claim 22, wherein edges of the indentations of each of the protrusion electrodes are rounded with no abrupt changes in angle.

25. The plasma display panel of claim 18, wherein the protrusion electrodes are transparent.

* * * * *

UNITED STATES PATENT AND TRADEMARK OFFICE

CERTIFICATE OF CORRECTION

PATENT NO. : 7,208,875 B2
APPLICATION NO. : 10/746540
DATED : April 24, 2007
INVENTOR(S) : Jae-ik Kwon et al.

It is certified that error appears in the above-identified patent and that said Letters Patent is hereby corrected as shown below:

In the Claims

| | |
|---|---|
| Column 14, line 15, Claim 12 | Delete "baffler",<br>Insert --barrier-- |
| Column 14, line 24, Claim 13 | Delete "baffler",<br>Insert --barrier-- |
| Column 14, line 36, Claim 13 | Delete "baffler",<br>Insert --barrier-- |
| Column 14, line 46, Claim 15 | Delete "baffler",<br>Insert --barrier-- |
| Column 14, line 49, Claim 16 | Delete "baffler rib members is higher than the second baffler",<br>Insert --barrier rib members is higher than the second barrier-- |
| Column 14, line 52, Claim 17 | Delete "baffler rib members is lower than the second baffler",<br>Insert --barrier rib members is lower than the second barrier-- |
| Column 14, line 58, Claim 18 | Delete "baffler",<br>Insert --barrier-- |

UNITED STATES PATENT AND TRADEMARK OFFICE

CERTIFICATE OF CORRECTION

PATENT NO. : 7,208,875 B2
APPLICATION NO. : 10/746540
DATED : April 24, 2007
INVENTOR(S) : Jae-ik Kwon et al.

It is certified that error appears in the above-identified patent and that said Letters Patent is hereby corrected as shown below:

| | |
|---|---|
| Column 14, line 59, Claim 18 | Delete "baffler",<br>Insert --barrier-- |

Signed and Sealed this

Eleventh Day of November, 2008

JON W. DUDAS
*Director of the United States Patent and Trademark Office*